US010039353B2

(12) United States Patent
Mullet et al.

(10) Patent No.: US 10,039,353 B2
(45) Date of Patent: Aug. 7, 2018

(54) UMBRELLA SYSTEM

(71) Applicant: Current Products Corp., Pensacola, FL (US)

(72) Inventors: Willis Jay Mullet, Gulf Breeze, FL (US); Richard Scott Hand, Pace, FL (US); John Foreman, Pace, FL (US)

(73) Assignee: CURRENT PRODUCTS CORP., Pensacola, FL (US)

( * ) Notice: Subject to any disclaimer, the term of this patent is extended or adjusted under 35 U.S.C. 154(b) by 0 days.

(21) Appl. No.: 15/286,701

(22) Filed: Oct. 6, 2016

(65) Prior Publication Data

US 2017/0099919 A1 Apr. 13, 2017

Related U.S. Application Data

(60) Provisional application No. 62/239,595, filed on Oct. 9, 2015.

(51) Int. Cl.

| | |
|---|---|
| ***A45B 25/14*** | (2006.01) |
| ***A45B 25/00*** | (2006.01) |
| ***A45B 25/16*** | (2006.01) |
| *A45B 23/00* | (2006.01) |

(52) U.S. Cl.

CPC ..... *A45B 25/143* (2013.01); *A45B 25/006* (2013.01); *A45B 25/14* (2013.01); *A45B 25/165* (2013.01); *A45B 2023/0012* (2013.01); *A45B 2200/1018* (2013.01); *A45B 2200/1063* (2013.01)

(58) Field of Classification Search

CPC ..... A45B 25/00; A45B 3/00; A45B 25/02; A45B 25/14; A45B 25/143; A45B 25/16; A45B 25/165; A45B 25/006; A45B 2200/1063; A45B 2023/0012; A45B 2200/1009; A45B 2017/005; A45B 37/04

USPC ..... 135/15.1, 16, 20.3, 28, 32, 98, 25.4, 22; 108/50.12

See application file for complete search history.

(56) References Cited

U.S. PATENT DOCUMENTS

| | | | | |
|---|---|---|---|---|
| 3,311,119 A * | 3/1967 | Pearlstine | ..... | A45B 17/00 135/20.3 |
| 3,870,062 A * | 3/1975 | Medlin | ..... | A45B 19/04 135/20.3 |
| 4,353,659 A * | 10/1982 | Comte | ..... | A47B 37/04 108/50.12 |

(Continued)

*Primary Examiner* — Winnie Yip

(74) *Attorney, Agent, or Firm* — Christopher A. Proskey; BrownWinick Law Firm

(57) ABSTRACT

An umbrella system includes a support pole connected to a rotating tube positioned around a center tube that extends between the support pole and a center support that is connected to an umbrella frame. The rotating tube has one or more helical grooves therein that are engaged by teeth of a hub which is connected to the umbrella frame. As the rotating tube is rotated, the hub is driven along the length of the rotating tube thereby opening and closing the umbrella frame. In one arrangement system includes a motor housing assembly including a plurality of batteries and a motor that includes a driven gear that meshes with a stationary gear which causes rotation of the rotating tube. The system also includes a counterbalance assembly positioned within the rotating tube. The counterbalance assembly includes at least one spring positioned within the rotating tube that provides a counterbalance force.

27 Claims, 26 Drawing Sheets

(56) References Cited

U.S. PATENT DOCUMENTS

| | | | | |
|---|---|---|---|---|
| 6,129,101 | A * | 10/2000 | Dubinsky | A45B 25/14 135/20.3 |
| 6,543,464 | B1 * | 4/2003 | Grady, II | A45B 25/14 135/20.3 |
| 7,562,666 | B2 * | 7/2009 | Chan | A45B 25/143 135/16 |
| 7,780,139 | B2 * | 8/2010 | Markert | E04H 12/2261 135/15.1 |
| 7,909,049 | B2 * | 3/2011 | Yang | A45B 19/04 135/20.3 |
| 8,459,281 | B2 * | 6/2013 | Chen | A45B 25/08 135/28 |
| 8,857,453 | B2 * | 10/2014 | Souma | A45B 25/143 135/20.3 |
| 9,259,064 | B1 * | 2/2016 | Chen | A45B 25/143 |
| 2006/0151019 | A1 * | 7/2006 | Lo | A45B 25/165 135/20.3 |
| 2010/0012164 | A1 * | 1/2010 | Stoelinga | A45B 25/14 135/20.3 |

* cited by examiner

12

UMBRELLA SYSTEM

CROSS REFERENCE PARAGRAPH

This application claims priority to U.S. Provisional Application No. 62/239,595 filed Oct. 9, 2015.

FIELD OF THE INVENTION

This invention relates to umbrellas. More specifically, and without limitation, this invention relates to a new manual and motorized umbrella system.

BACKGROUND OF THE INVENTION

Umbrellas are old and well known in the art. While other forms of umbrellas exist, there are essentially two broad categories of umbrellas, hand held umbrellas and patio umbrellas. Handheld umbrellas are generally light and of small stature such that they can be held by a user in the rain or sunshine. Handheld umbrella serve to deflect the rain or sun away from the user. Patio umbrellas are on the other hand generally larger in stature and remain in a generally fixed position such as on a patio or other outdoor seating space, and serve to deflect rain and sun away from the area under the patio umbrella. Patio umbrellas also provide an improved aesthetic appearance to the outdoor seating area and help to define seating space.

For the purposes of this disclosure, use of the term umbrella herein will generally refer to patio-type umbrellas, however the disclosure herein is not so limited and the teachings herein are applicable to any umbrella design or type.

Conventional patio umbrellas have an elongated support pole that connects at a lower end to a base and includes an umbrella section at an upper end. The umbrella section includes material connected to an umbrella frame that converts between a retracted position, where the umbrella frame and material are collapsed and in a lowered position against or near the support pole, and a deployed position wherein the umbrella frame and material are in extend away from the support pole.

There are a plurality of ways in which conventional prior art patio umbrellas convert between a retracted position to a deployed position. One of the simplest mechanisms is a manual-type system that includes connecting the lower portion of the umbrella frame to a hub that slides over the support pole. In this arrangement, the support pole includes one or more openings therein that receive a locking pin therein. To deploy the umbrella, a user simply grasps the hub and slides it upward until the hub passes an opening and the user inserts a locking pin therein which prevents the hub from sliding down the support pole thereby holding the umbrella in a deployed position. While this simple system is effective in some applications, it has its drawbacks.

One drawback is that manually deploying the umbrella is time consuming and inconvenient for a user. Another drawback is that deploying the umbrella using this system requires a great amount of force which may be more than many users can apply especially the young, the old, and persons of smaller stature. In addition, many persons of shorter stature are unable to reach the hub or move it all the way up to the desired deployed position. Another drawback is that when the umbrella is placed in the center of a table, it can be tremendously difficult to deploy the umbrella because the width of the table. Another drawback is that the larger the umbrella is the more difficult it is to deploy the umbrella because of increased weight and/or resistance. Another drawback of this arrangement is that it can be quite a difficult balancing act to force the umbrella upward while inserting the locking pin into the locking opening, which is a process that requires a tremendous amount of dexterity. Another drawback of this arrangement is that it can be quite difficult to remove the locking pin after use lower the umbrella. Another drawback of this arrangement is that the pin can be lost. Another drawback is that the user must force the hub upward against the resistance of the umbrella material, which can be exceedingly difficult. Another drawback of this system is that it can be difficult to get the umbrella material taught due to the spacing of the locking holes in combination with the inability of the user to overcome the resistance in the fabric. These are only some of the many disadvantages of this system.

Another system for raising and lowering the umbrella is a crank-type system. These crank type systems include a rotating handle connected to a gear system near the mid-section of support pole, often positioned just above, or just below, a table top. This handle and gear system is connected to a mechanism, such as a cable, that moves the umbrella frame between a deployed position and a retracted position when rotated. The crank-type system improves many of the deficiencies of the manual-type system such as eliminating the need to reach all the way up the support pole to deploy or retract the umbrella. Another improvement is that by using the gear system, some of the forces required to raise or lower the umbrella can be reduced or overcome. The mechanical advantage provided by the crank-type system allows a user to more-easily tighten the umbrella material. In addition, because there are no set discrete positions like there are with the manual locking pin system described above, the user can move the crank to essentially any position and thereby select the appropriate amount of tension in the umbrella material.

Despite these advantages, the crank-type system still suffers from many of the same disadvantages as the manual-type system. One drawback of the crank-type system is that operating the crank can be quite inconvenient and difficult for a user. In addition, when the umbrella is used in association with a table the crank can be difficult to reach. Another disadvantage to this system is that the crank mechanism itself can be in the way during use especially when the crank is positioned above a table. Another problem with this arrangement is that it still suffers from the disadvantage that the larger the umbrella the greater the amount of force that is required to raise and lower the umbrella. Another disadvantage is that the large gear system and crank handle are aesthetically unappealing in many applications. Yet another disadvantage is that many operators are not strong enough or have enough dexterity to operate the crank system. Another disadvantage, like the manual-type system, is that the umbrella must be lowered by the force of the user. Another disadvantage of this system is that the process of cranking the umbrella up and down can be quite awkward. These are only some of the many disadvantages of this system.

One common problem associated with the use of patio umbrellas is that users often forget to lower the umbrella after use. This is often because after use it is unappealing for the user to put in the manual labor required to lower the umbrella. Leaving the umbrella in a deployed position when not in use or when unattended often creates a dangerous condition that can damage property and the umbrella. If the umbrella is left deployed during high winds, the winds can lift up the umbrella and damage the umbrella or other property. As such, it is desirable to have an umbrella that can be lowered without the manual force of the operator.

Therefore, for the reasons stated above, and for other reasons stated below which will become apparent to those skilled in the art upon reading and understanding the specification, there is a need in the art for an improved umbrella system.

Thus, it is a primary object of the invention to provide an umbrella system that improves upon the state of the art.

Another object of the invention is to provide an umbrella system that is easier to deploy.

Yet another object of the invention is to provide an umbrella system that is easier to retract.

Another object of the invention is to provide an umbrella system that auto opens.

Yet another object of the invention is to provide an umbrella system that auto closes.

Another object of the invention is to provide an umbrella system that is powered by batteries.

Yet another object of the invention is to provide an umbrella system that does not need to be plugged into a conventional power source to be operable.

Another object of the invention is to provide an umbrella system that is aesthetically pleasing.

Yet another object of the invention is to provide an umbrella system that improves safety.

Another object of the invention is to provide an umbrella system that can be remotely opened.

Yet another object of the invention is to provide an umbrella system that can be remotely closed.

Another object of the invention is to provide an umbrella system that can be manually opened or closed with ease.

Yet another object of the invention is to provide an umbrella system that can be opened or closed by motorization.

Another object of the invention is to provide an umbrella system that improves the ergonomics of opening or closing an umbrella.

Yet another object of the invention is to provide an umbrella system that can be used with large umbrellas.

Another object of the invention is to provide an umbrella system that is relatively inexpensive to manufacture.

Yet another object of the invention is to provide an umbrella system that has a minimum number of parts.

Another object of the invention is to provide an umbrella system that counterbalances the weight of the umbrella.

Yet another object of the invention is to provide an umbrella system that has an intuitive design.

Another object of the invention is to provide an umbrella system that has a long useful life.

Yet another object of the invention is to provide an umbrella system that is rugged.

Another object of the invention is to provide an umbrella system that is durable.

Yet another object of the invention is to provide an umbrella system that utilizes standard batteries.

Another object of the invention is to provide an umbrella system that is safe to use.

These and other objects, features, or advantages of the invention will become apparent from the specification and claims.

SUMMARY OF THE INVENTION

An umbrella system includes a support pole connected to a rotating tube positioned around a center tube that extends between the support pole and a center support that is connected to an umbrella frame. The rotating tube has one or more helical grooves therein that are engaged by teeth of a hub which is connected to the umbrella frame. As the rotating tube is rotated, the hub is driven along the length of the rotating tube thereby opening and closing the umbrella frame. In one arrangement system includes a motor housing assembly including a plurality of batteries and a motor that includes a driven gear that meshes with a stationary gear which causes rotation of the rotating tube. The system also includes a counterbalance assembly positioned within the rotating tube. The counterbalance assembly includes at least one spring positioned within the rotating tube that provides a counterbalance force.

DETAILED DESCRIPTION

Figure 1:
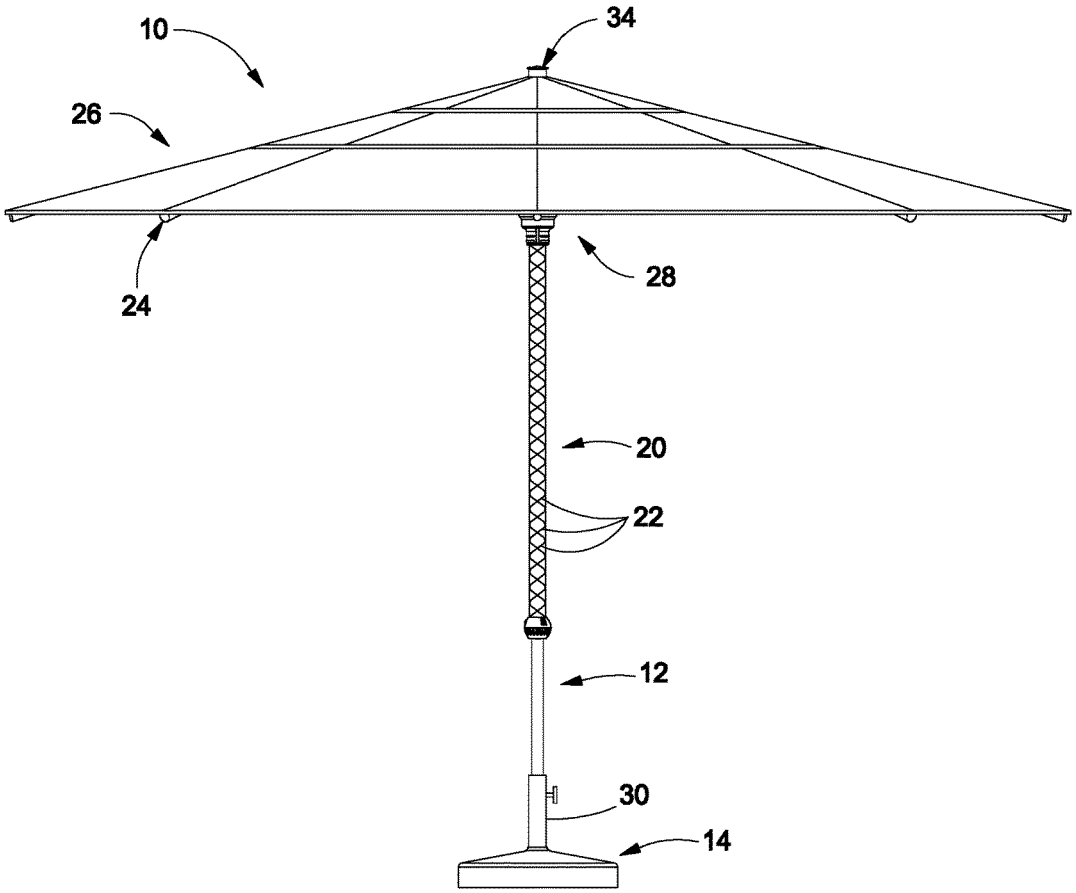
FIG. 1 is an elevation view of a manual umbrella system, the view showing the support pole, base, rotating tube having four helical grooves therein including two clockwise rotating helical grooves positioned on opposing sides of the rotating tube and two counterclockwise rotating helical grooves positioned on opposing sides of the rotating tube with the clockwise and counterclockwise helical grooves periodically intersecting one another across the entire length of the rotating tube, a hub, an umbrella frame, umbrella material and a center support connecting the umbrella frame to a center tube, the view showing the umbrella in an open position.
Figure 2:
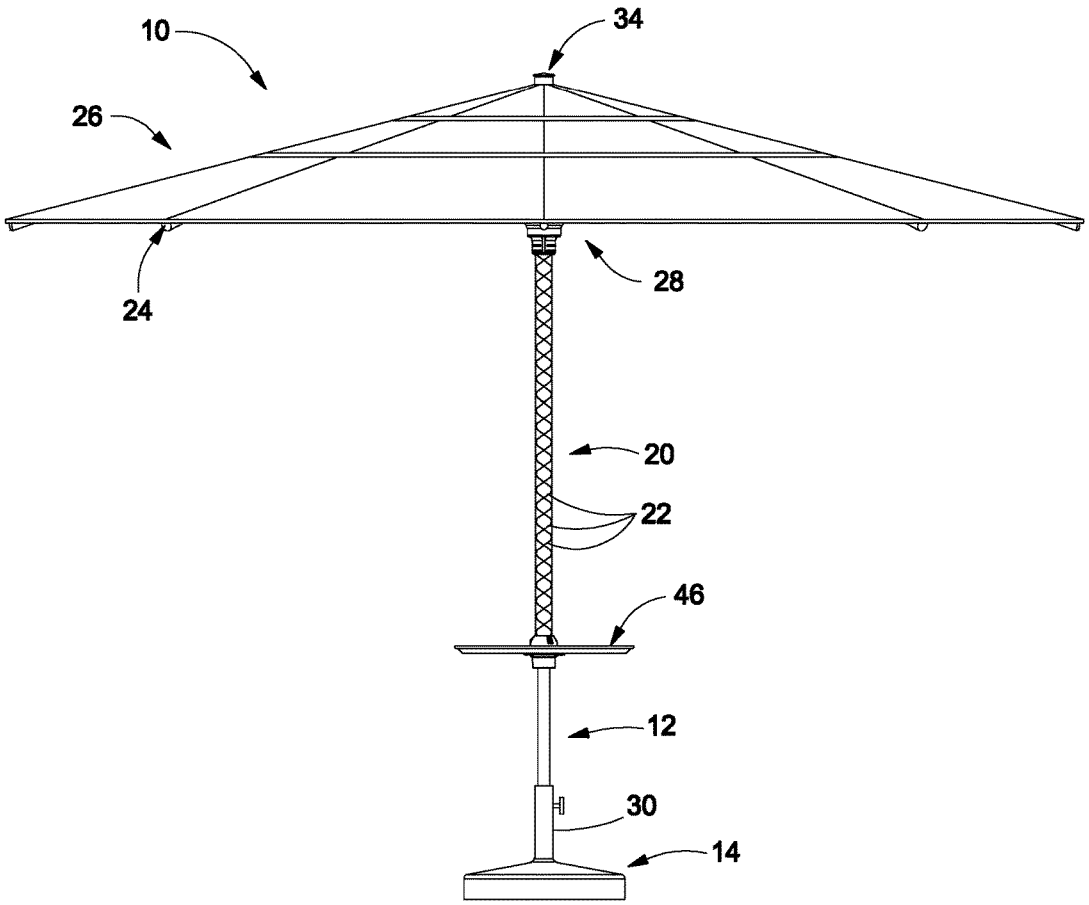
FIG. 2 is an elevation view of the manual umbrella system of claim 1, the view also showing the addition of a table.
Figure 3:
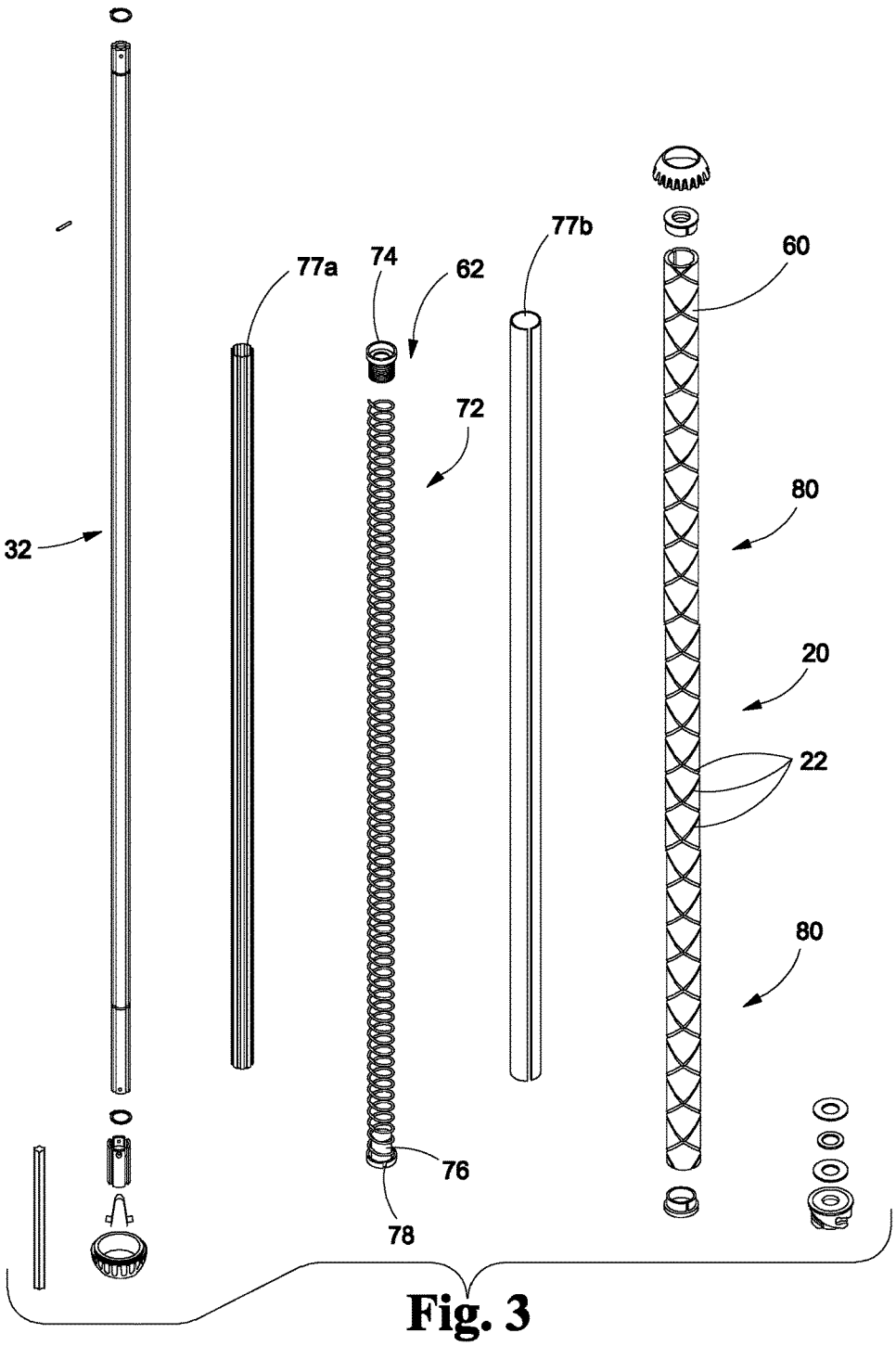
FIG. 3 is a perspective exploded view of the rotating tube assembly shown in FIGS. 1 and 2, the view showing the rotating tube, the center tube, the counterbalance assembly, the inner sleeve and the outer sleeve.
Figure 4:
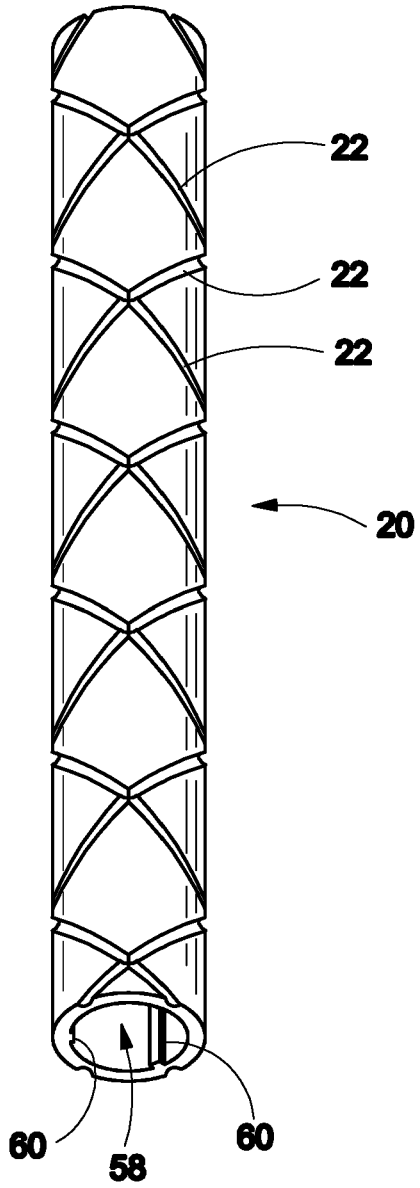
FIG. 4 is a perspective view of a portion of the center tube, the view showing the rotating tube having four helical grooves in its exterior surface including two clockwise rotating helical grooves positioned on opposing sides of the rotating tube and two counterclockwise rotating helical grooves positioned on opposing sides of the rotating tube with the clockwise and counterclockwise helical grooves periodically intersecting one another across the length of the rotating tube, the view also showing the hollow interior having features therein, which in this example are protrusions or rails within the hollow interior.
Figure 5:
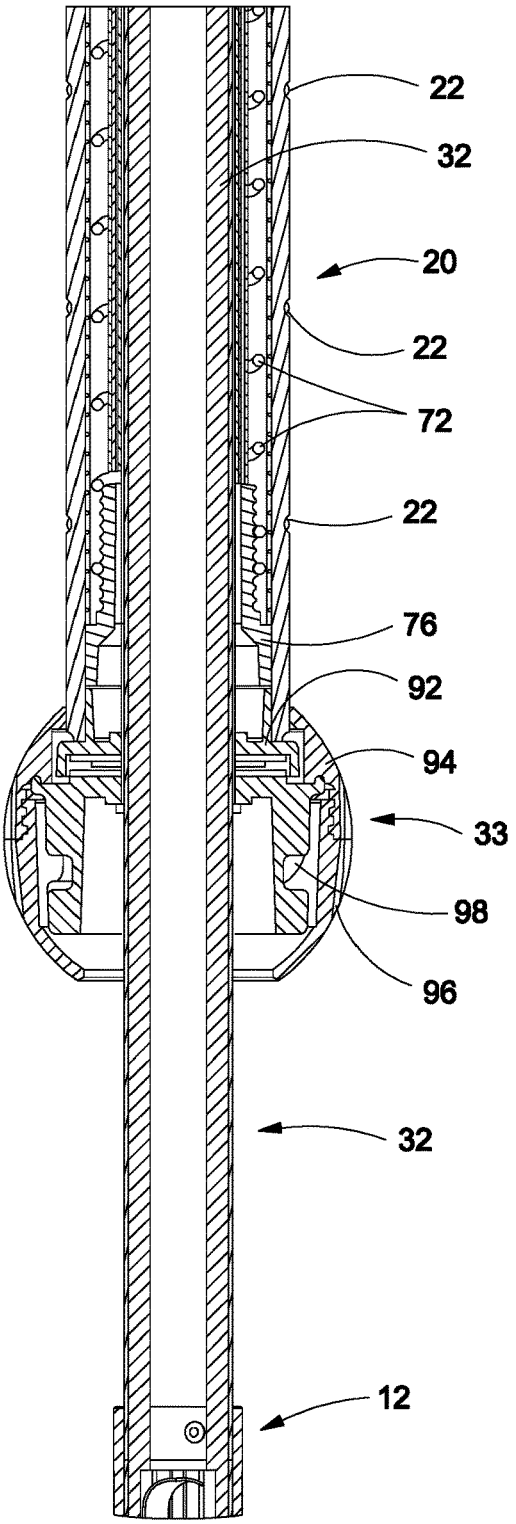
FIG. 5 is a side cut-away elevation view of the lower end of the rotating tube, the center tube and the support pole, the view showing the counterbalance assembly having a spring and an inner sleeve and an outer sleeve positioned within the rotating tube and around the center tube.
Figure 6:
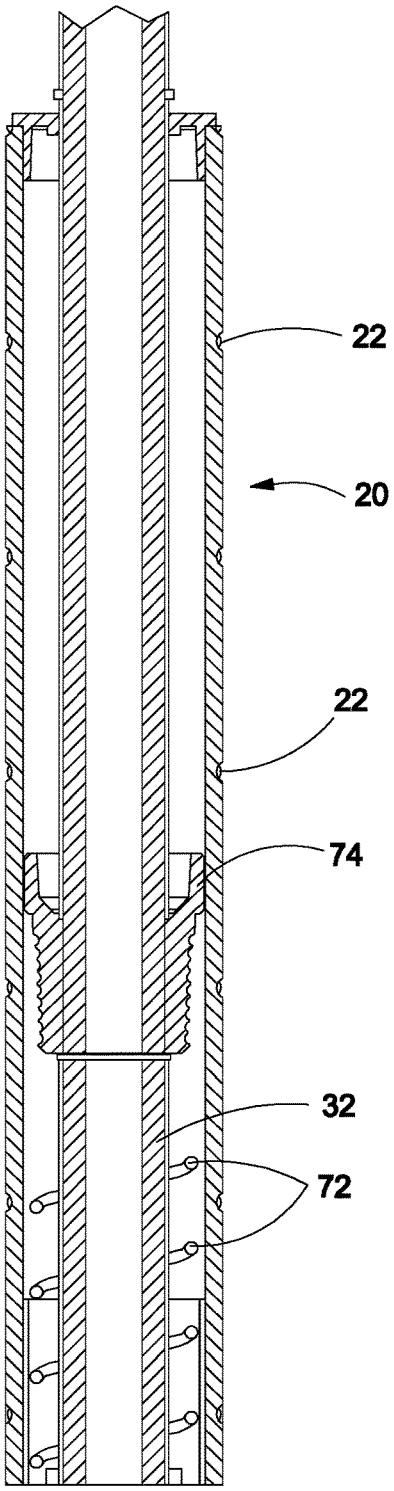
FIG. 6 is a side cut-away elevation view of the upper end of the rotating tube, the center tube and the support pole, the view showing the counterbalance assembly having a spring and an inner sleeve and an outer sleeve positioned within the rotating tube and around the center tube.
Figures 7A, 7B:
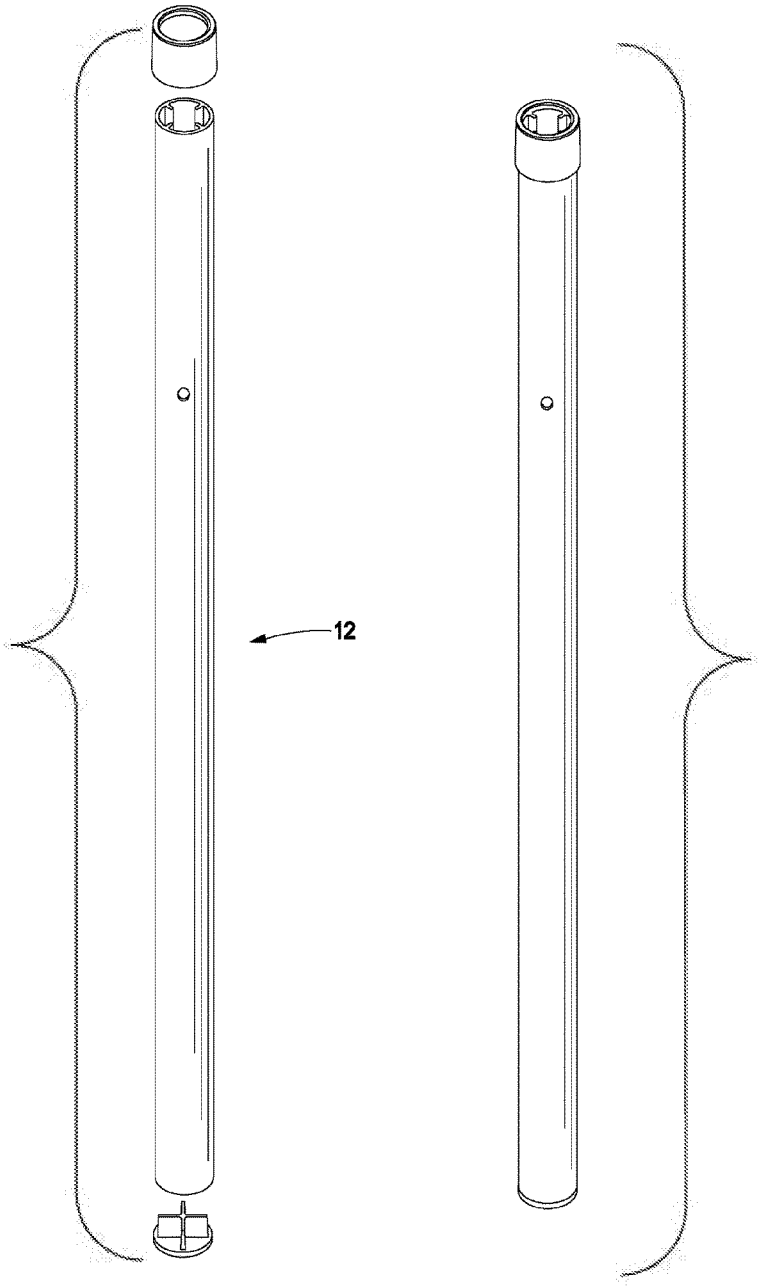
FIG. 7A is a perspective view of the support pole in an exploded state.
FIG. 7B is a perspective view of the support pole in an assembled state.
Figure 8:
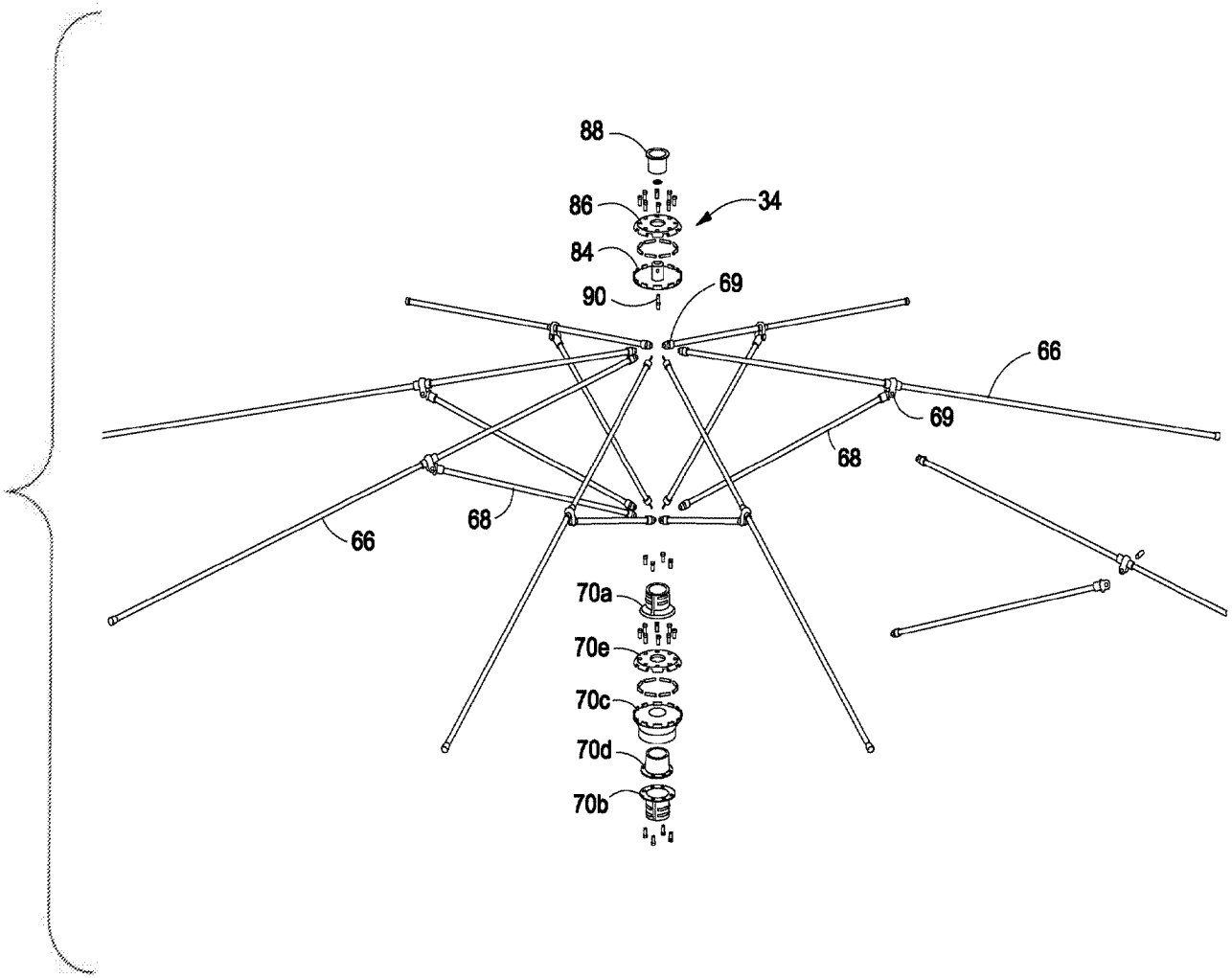
FIG. 8 is an exploded perspective view of the umbrella frame, the view showing the center support and hub in an exploded arrangement, the view also showing the upper supports and the lower supports and how they connect to one another and to the upper support and the lower support, the view showing the umbrella frame in an open position.
Figure 9:
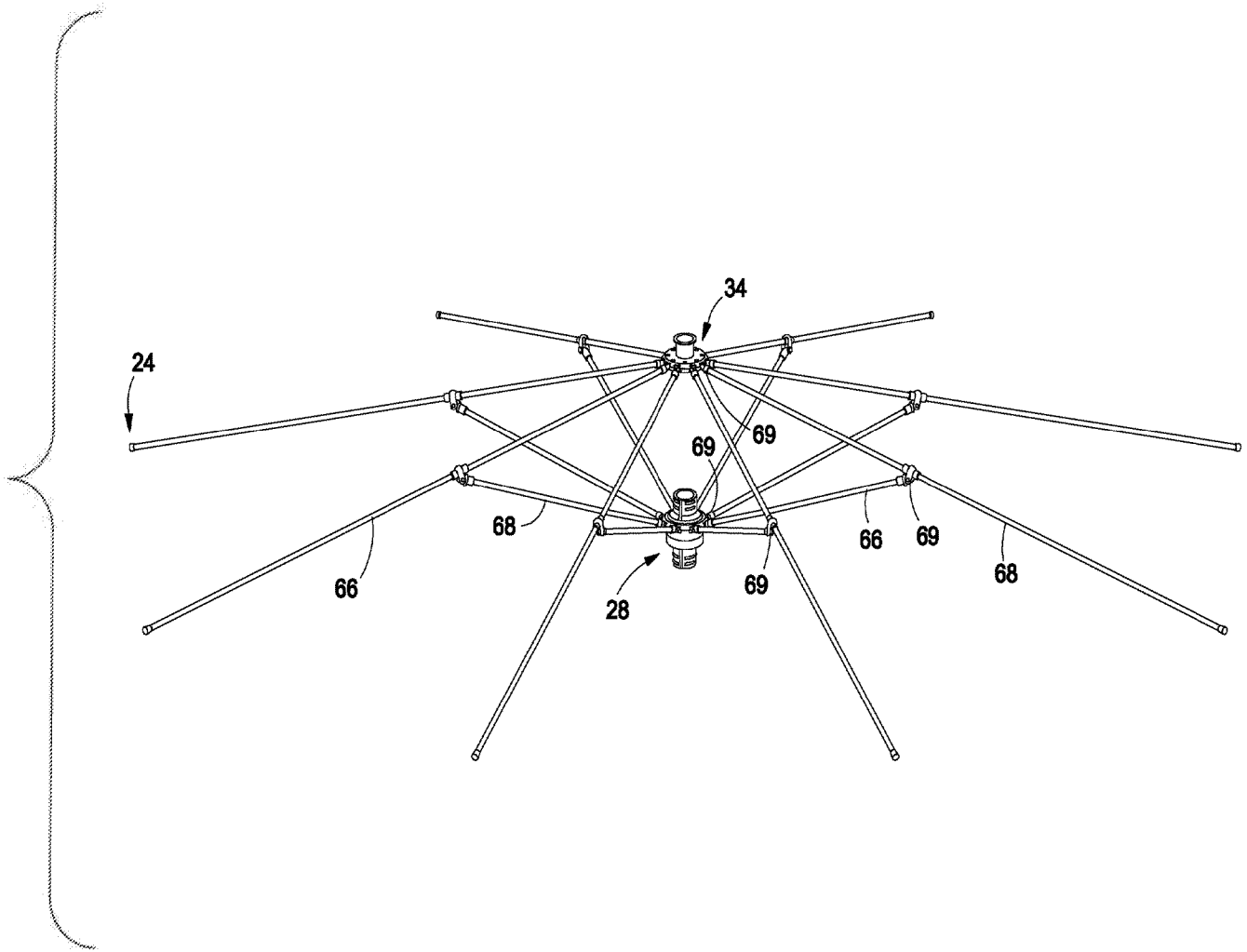
FIG. 9 is a perspective view of the umbrella frame of FIG. 8, the view showing the upper support and the hub and the umbrella frame in an assembled state.
Figure 10:
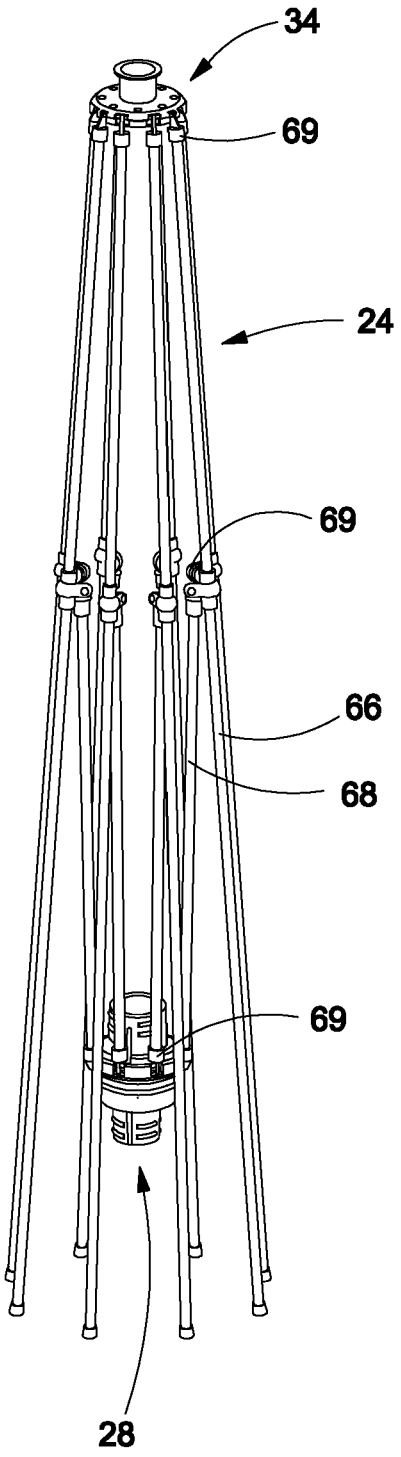
FIG. 10 is a perspective view of the umbrella frame of FIGS. 8 and 9, the view showing the umbrella frame in a closed position.
Figure 11:
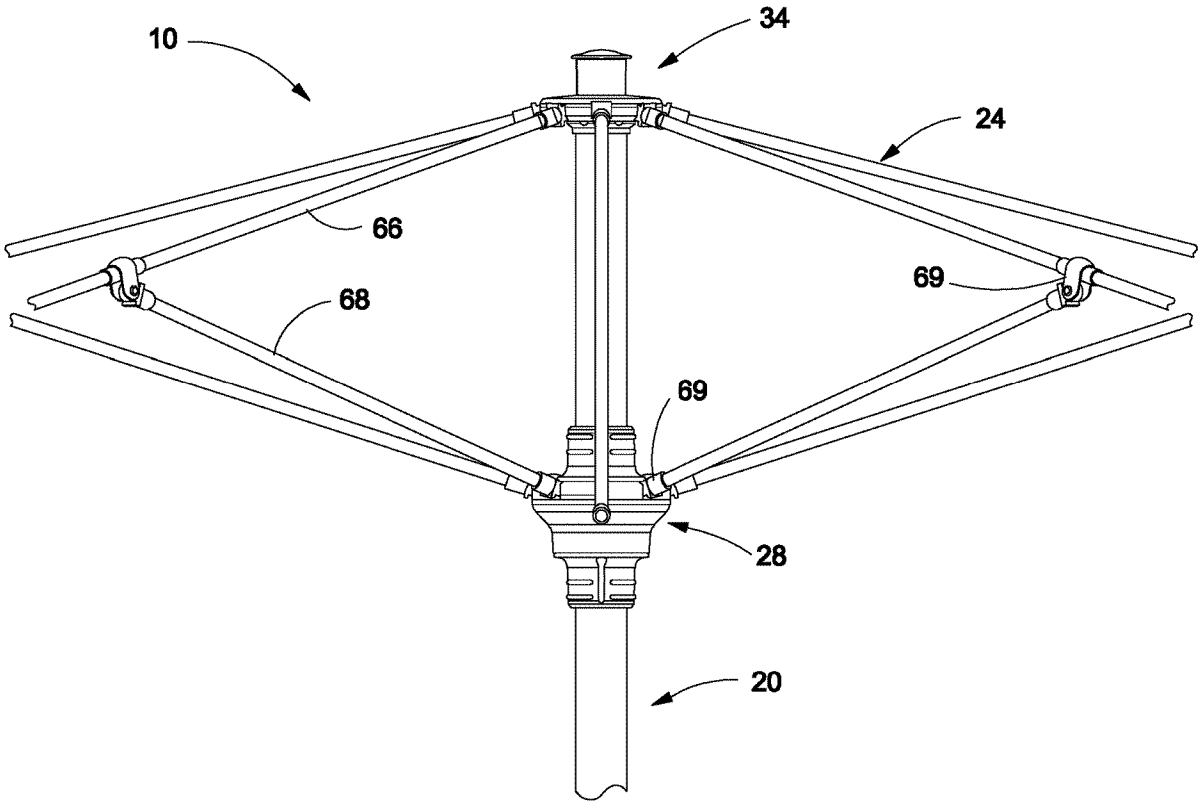
FIG. 11 is a close up elevation view of the umbrella frame, the view showing the umbrella frame, the center support and the hub in an assembled state, the view showing the umbrella frame in an open position.
Figure 12:
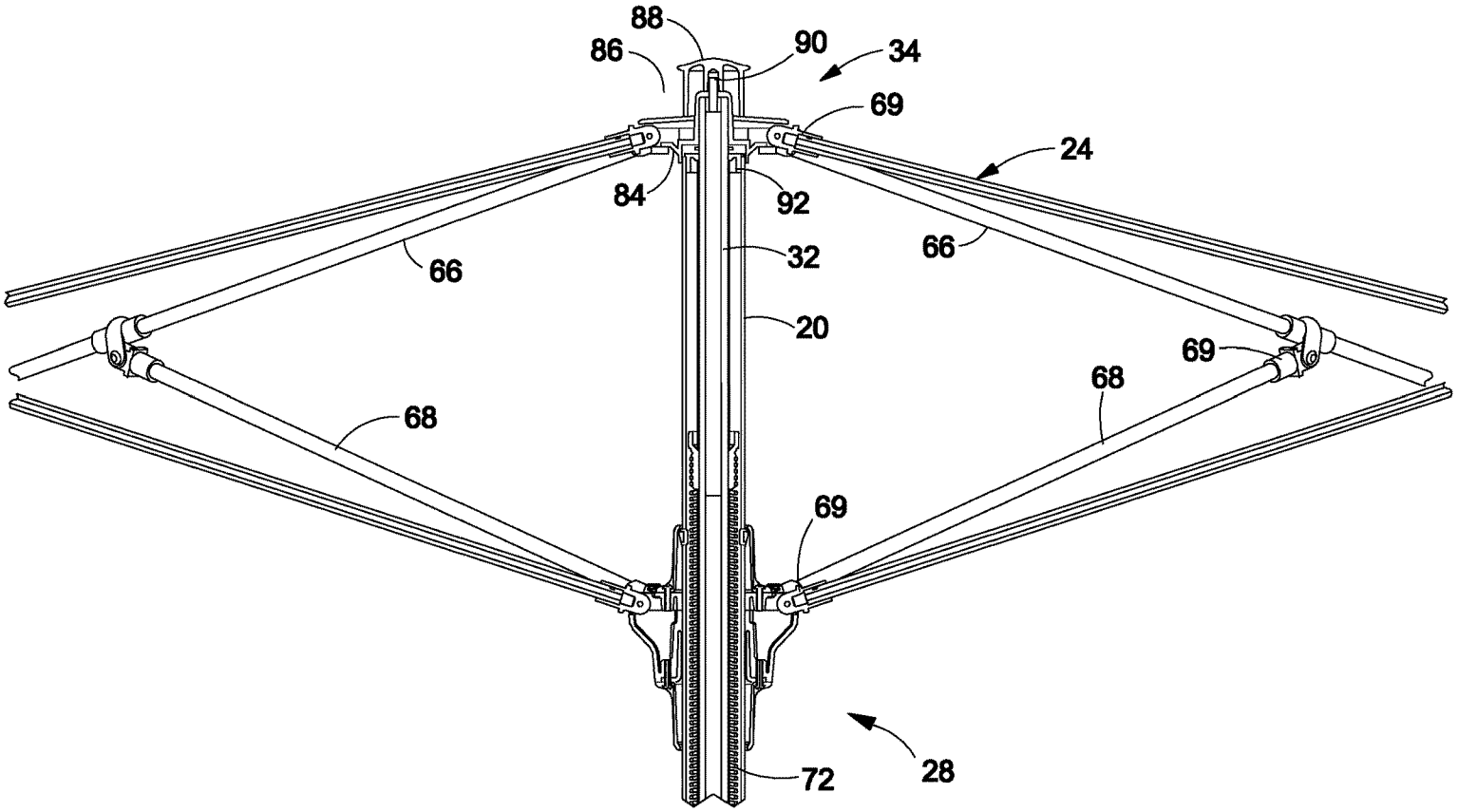
FIG. 12 is a side cut-away elevation view of the umbrella frame of FIG. 11, the view showing center tube and counterbalance assembly positioned within the rotating tube, the view showing the umbrella frame in an open position.

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that mechanical, procedural, and other changes may be made without departing from the spirit and scope of the invention. The following detailed description is, therefore, not to be taken in a limiting sense, and the scope of the invention is defined only by the appended claims, along with the full scope of equivalents to which such claims are entitled.

As used herein, the terminology such as vertical, horizontal, top, bottom, front, back, end, sides, and the like, are referenced according to the views presented. It should be understood, however, that the terms are used only for purposes of description, and are not intended to be used as limitations. Accordingly, orientation of an object or a combination of objects may change without departing from the spirit or scope of the invention.

While the figures show the invention used in association with a patio umbrella, the invention is not so limited, and reference herein to a patio umbrella is not intended to be limiting. In contrast, a patio umbrella is simply used as one of countless examples. It is hereby contemplated that the invention may also be used with any form of an umbrella, and for that matter any applicable mechanical device.

Umbrella system 10 (system 10) is presented. Umbrella system 10 includes a support pole 12, a base 14, a motor housing assembly 16, a table 18, a rotating tube 20, having one or more helical grooves 22 therein and an umbrella frame 24 that supports fabric or material 26 and is connected to a movable hub 28.

Support Pole & Base:

Support pole 12 is formed of any suitable size, shape and design and serves to support and position the other components of the system 10 at the proper height. In the arrangement shown, support pole 12 is a generally cylindrical pole that extends from a lower end to an upper end. The lower end of support pole 12 is connected to base 14. In one arrangement, the lower end of support pole 12 fits within a hollow tube of base stem 30 which is connected to base 14.

Base 14 is formed of any suitable size, shape and design and is generally heavy and rigid and thereby provides stability for the remaining parts of the system.

The upper end of support pole 12 connects to center tube 32 and provides support thereto. 16. Support pole 12 and center tube 32 connect to rotating tube 20 by lower bearing assembly 33. In one arrangement, as is shown, support pole 12 and rotating tube 20 are hollow and cylindrical in nature. Center tube 32 is any elongated device that extends through rotating tube 20 and remains stationary while rotating tube 20 rotates there around. As such, the stationary nature of support pole 12 and center tube 32 allows for the transfer of torque or rotation to rotating tube 20 as is further described herein. Center tube 32 connects at its lower end to support pole 12 and connects at its upper end to center support 34 of umbrella frame 24.

Also connected adjacent the intersection of center tube 32 and rotating tube 20 is a stationary gear 36. Stationary gear 36 is any form of a gear that remains stationary with respect to support pole 12 and center tube 32. In the arrangement shown, stationary gear 36 is generally cylindrical in nature and has gear teeth on an inwardly facing surface, however the alternative arrangement is hereby contemplated where teeth are located on an outward surface of stationary gear 36. This stationary gear 36 matingly receives a driven gear 38 connected to motor 40 which drives around the stationary gear 36 to open and close the umbrella system 10 as is further described herein.

Motor Housing Assembly:

Motor housing assembly 16 serves to drive rotating tube 20 in a motorized manner thereby opening and closing umbrella system 10. Motor housing assembly 16 is formed of any suitable size, shape and design and serves to open and close the umbrella 10. In the arrangement shown, motor housing assembly 16 includes a container 41 that holds and shelters motor 40 as well as power source 42, which in the arrangement shown is a plurality of batteries 44 that are positioned around rotating tube 20 and center tube 32. In the arrangement shown, container 41 is connected to rotating tube 20 at its inward end, and therefore container 41, and the other components of motor housing assembly 16 rotate as the rotating tube 20 rotates.

Batteries 44 are held within a battery holder 45. Battery holder 45 frictionally hold batteries 44 in place around the exterior surface of rotating tube 20 while also providing electrical connection between the plurality of batteries 44. In the arrangement shown, battery holder 45 holds the plurality of batteries 44 which are stacked in a generally vertical arrangement around the exterior surface of rotating tube 20 such that the exterior surfaces of the plurality of batteries 44 form a generally cylindrical exterior periphery when viewed from above or below. This arrangement maximizes battery density while minimizing space used. While batteries 44 are stacked in side-to-side nature they are electrically connected in series to one another by battery holder 45.

Motor 40 is formed of any suitable size, shape and design. In the arrangement shown, motor 40 is generally tubular in shape or cylindrical in shape and includes a drive shaft 40A that connects to driven gear 38 and imparts rotation on driven gear 38 when motor 40 is activated. In one arrangement, to reduce the rotational output speed of driven gear 38 a gear assembly 40B is connected between an output shaft of motor 40 and driven gear 38. This gear assembly 40B facilitates slower rotation of driven gear 38 than the rotational speed of the output shaft of motor 40.

In the arrangement shown, as motor 40 is sized and shaped in a similar manner to batteries 44, and as such motor 40 is held by battery holder 45 in a side-to-side adjacent manner with the plurality of batteries 44. That is, motor 40 is positioned in a vertical alignment, like batteries 44, around the exterior surface of rotating tube 20. Motor 40 is oriented such that drive shaft 40A and driven gear 38 extend below the lower surface of motor housing assembly 16 and container 41. This downward extension of driven gear 38 facilitates the engagement of driven gear 38 with stationary gear 36. However, the opposite arrangement is hereby contemplated for use as one alternative wherein the motor 40 remains stationary while gear 36 rotates.

A table 46 is also connected to system 10 at or near the motor housing assembly 16 and just below the lower end of container 41. Table 46 is formed of any suitable size, shape and design and can either be connected to the stationary center tube 32 such that it is non-rotational in nature, or it is connected to the rotating tube 20 such that the table 46 is rotational in nature.

When table 46 is rotational in nature, and is therefore connected to rotating tube 20, table 46 can be used to raise and lower the umbrella frame 24 by manually rotating the table 46. When table 46 is rotational in nature, and is therefore connected to rotating tube 20, table 46 can also be used to raise and lower the umbrella frame by starting or stopping motor 40 by moving or initiating rotation of table 46 or alternatively stopping or stopping rotation of table 46 as is further described herein. When the table 46 is used to open and close the system 10, the increased diameter of table 46 provides a mechanical advantage thereby making it easier to open and close the system 10.

In one arrangement table 46 extends outward from rotating tube 20 in a generally perpendicular nature such that table 46 provides a generally flat and level upper surface. In one arrangement, table 46 has a generally circular or cylindrical shape when viewed from above or below, however any other shape is hereby contemplated for use. An optional table extension 48 is connected to table 46 by any engagement member, manner or method, and serves to extend the size or diameter of table 46 and provide greater table top surface area. In one arrangement, table extension 48 connects to table 46 by way of clips 50. In one arrangement, table 46 is connected to rotating tube 46 and therefore is rotational in nature. In contrast, in another arrangement, table extension 48 is connected to center tube 32 and therefore table extension 48 is non-rotational in nature.

A cover 52 is connected to the upper end of container 41 and covers container 41. Cover 52 is formed of any suitable size shape and design and serves to hold lighting elements 54, which are any form of a light producing device such as one or more light bulbs, LEDs or the like. In one arrangement, cover 52 is vertically fixed, or fixed to the upper end of container 41, or cover 52 is formed as a unitary part of container 41. In an alternative arrangement, cover 52 is a separate part from container 41 and in this arrangement cover 52 is vertically movable along rotating tube 20 so as to allow the positioning of cover 52 and lighting elements 54 at the appropriate position above table 46. To facilitate this vertical movement, cover 52 is connected to power source 42 by a flexible cord 56 that accommodates any positioning of cover 52 along the length of rotating tube 20. In one arrangement, cover 52 is generally circular in shape when viewed from above and below so as to mimic the exterior shape of container 41.

In one arrangement, cover 52 has a slightly larger diameter than the exterior diameter of container 41 and includes a curved or angled upper surface 52A and a curved or angled lower surface 52B. In one arrangement, the lighting elements 54 are positioned at or near the exterior periphery of cover 52 and/or in the lower surface 52*b*. This configuration allows lighting elements 54 to be positioned beyond the exterior surface of container 41 and further allows lighting elements 54 to shine down upon the table top of table 46/48 when lighting elements 54 are present. The curved or angled upper surface 52A facilitates water and debris to roll off of the cover 52 and away from the container 41. This configuration provides both useful light on the table top as well as an elegant ambiance.

Rotating Tube:

Rotating tube 20 is formed of any suitable size, shape and design. As motor 40 is activated, motor 40 rotates driven gear 38 which meshes with stationary gear 36 thereby driving motor 40, and the components connected thereto (including rotating tube 20 and motor housing assembly 16) in circular fashion. Rotating tube 20 includes one or more helical grooves 22 therein. In one arrangement a single helical groove 22 is used, either clockwise rotating or counterclockwise rotating. In another arrangement a pair of helical grooves 22 are used, either both clockwise rotating or counterclockwise rotating, or one clockwise rotating and one counterclockwise rotating. In yet another arrangement, as is shown, four helical grooves 22 are used, two clockwise rotating and two counterclockwise rotating, wherein the clockwise rotating and counterclockwise rotating helical grooves intersect with one another. Also, in the arrangement shown, the two clockwise helical grooves 22 are positioned at all times on opposite or opposing sides of the rotating tube 20 from one another and the two counterclockwise helical grooves 22 are positioned at all times on opposite or opposing sides of the rotating tube 20 from one another. While only one of either a clockwise rotating helical groove or a counterclockwise rotating helical groove 22 are needed for operation, having two clockwise rotating and two counterclockwise rotating helical grooves 22 that intersect one another provides an appealing aesthetic appearance. In one arrangement, these helical grooves 22 extend from end to end along the entire length of rotating tube 20, whereas in an alternative arrangement, these helical grooves 22 only extend a portion of the length of rotating tube 20. In addition, by placing a pair of helical grooves on opposing sides of the rotating tube 20 and engaging these opposing helical grooves 22 with a tooth 70 of hub 28 provides greater stability and smoother operation as compared to only using a single helical groove 22. The use of any number of helical grooves 22 are hereby contemplated for use.

Rotating tube 20 includes a hollow interior 58 that provides space for center tube 32 therein. The interior surface of rotating tube 20 also includes one or more features 60 therein, such as ridges, grooves or other aberrations that are used to connect counterbalance assembly 62 thereto as is further described herein.

In one arrangement, in addition to having one or more helical grooves 22 therein, the exterior surface of rotating tube 20 includes one or more lateral grooves 64 (not shown in the figures). Lateral grooves 64 extend in a straight fashion along the lateral length of rotating tube 20. In one arrangement, these lateral grooves 64 extend from end to end across the entire length of rotating tube 20, whereas in an alternative arrangement, these lateral grooves 64 only extend a portion of the length of rotating tube 20.

Hub:

Hub 28 is formed of any suitable size, shape and design and serves to open and close umbrella frame 24 as rotating tube 20 is rotated. Hub 28 is connected to the non-rotating center support 34 by connection to the upper supports 66 of umbrella frame 24 which are connected to lower supports 68 of umbrella frame 24. Upper supports 66 connect to lower supports 68 by joints 69; similarly hub 28 connects to lower supports 68 by joints 69; similarly center support 34 connects to upper supports 66 by joints 69. Joints 69 are any connecting member that provides connection while also providing the needed articulation for opening and closing of the umbrella frame 24. Upper supports 66 of umbrella frame 24 serve to connect to material 26 and support material 26 when umbrella frame 24 is in a fully extended or deployed position. Lower supports 68 of umbrella frame 24 connect between hub 28 and upper supports 66 and serve to move the upper supports 68 between the retracted position or closed position and the deployed position or open position as hub 28 moves up and down along a length of the rotating tube 20. That is, this connection between hub 28, lower supports 68, upper supports 66 and center support 34 causes hub 28 to be non-rotational while allowing hub 28 to travel vertically along the vertical length of rotating tube 20.

Hub 28 includes one or more teeth 70 positioned on the inward facing surface of hub 28. This tooth 70 or these teeth 70 are keyed to be received within one of the helical grooves 22. To facilitate smooth operation, teeth 70 are formed of an elongated nature, or said another way, teeth 70 are generally extended in nature. In one arrangement, the length of teeth 70 can range anywhere from ¼ of an inch to well over 2 or 3 inches in length. Again, the elongated nature of teeth 70 provides greater surface area of engagement between teeth 70 and helical grooves 22 thereby providing smooth operation and reducing the possibility that teeth 70 could skip out of helical groove 22.

In one arrangement, to aid in smooth operation, hub 28 is generally vertically elongated so as to cover a vertical portion of rotating tube 20. In the arrangement shown, hub is formed of an upper collar 70A, a lower collar 70B, a center collar 70C, an interior collar 70D and a connecting collar 70E. Each of the upper collar 70A, lower collar 70B, center collar 70C, interior collar 70D and connecting collar 70E are generally cylindrical in shape or tubular in shape and have a hollow interior that extend around a portion of the rotating tube 20. The lower end of upper collar 70A connects to the upper end of connecting collar 70E, the lower end of connecting collar 70E connects to the upper end of center collar 70C, the upper end of lower collar connects to the lower end of center collar 70C. Interior collar 70D fits generally within center collar 70C and between the upper end of lower collar 70B and the lower end of upper collar 70A. In the arrangement shown, interior collar 70D has an elongated or extended interior surface that is sized and shaped to fit around the exterior surface of rotating tube 20 with close and tight tolerances, while still allowing for smooth and easy sliding over the exterior surface of rotating tube 20. Teeth 70 are positioned within this interior surface of interior collar 70D and extend inward and engage grooves 22. In an alternative arrangement, upper collar 70A, lower collar 70B and/or center collar 70C also have an elongated or extended interior surface that include teeth 70 therein, the interior surface being sized and shaped to fit around the exterior surface of rotating tube 20 with close and tight tolerances, while still allowing for smooth and easy sliding over the exterior surface of rotating tube 20.

Connecting collar 70E includes a plurality of recesses therein. These recesses receive the lower end of lower supports 68 and connect thereto with joints 69 that facilitate articulation of umbrella frame 24 during opening and closing.

Counterbalance Assembly:

Counterbalance assembly 62 is formed of any suitable size, shape and design and serves to provide a counterbalance force that counteracts the forces involved in raising and lowering, the umbrella. In the arrangement shown, counterbalance assembly 62 is positioned within the hollow interior 58 of rotating tube 20 and includes a spring 72 that is connected at a first end to a stationary perch 74 and at a second end to a rotating perch 76. As the rotating tube 20 is vertically aligned the stationary perch 74 can be positioned either above or below the rotating perch 76, with the stationary perch 74 connected to center tube 32 and the rotating perch 76 connected to the rotating tube 20.

In one arrangement, as is shown, stationary perch 74 is connected to center support 34 adjacent the upper end of center tube 32 within the upper end of rotating tube 20. Stationary perch 74 is connected to center tube 32 by any manner, method or means such as threading, bolting, pinning, riveting, gluing, welding, or any other manner of connection.

In this arrangement, rotating perch 76 is connected to the interior surface of hollow interior 58. In one arrangement, this connection is similarly made by any manner, method or means such as threading, bolting, pinning, riveting, gluing, welding, or any other manner of connection. In the arrangement shown, as one example, mating engagement of grooves 78 in the exterior surface of rotating perch 76 with the features 60 in the hollow interior 58 of rotating tube 20 is used such that when rotating tube 20 rotates so rotates rotating perch 76.

As rotating perch 76 rotates while stationary perch 74 remains stationary, forces are built up within, or released from, spring 72, thereby providing a counterbalance force to the force of raising the umbrella frame 24. This counterbalance force can substantially reduce the amount of energy needed to raise or lower the umbrella frame 24, which is highly advantageous, especially in a battery powered application as the less force required, the longer the battery life. The spring 72, rotating perch 76 and stationary perch 74 fit around center tube 32.

To provide quieter and smoother operation, in one arrangement an interior sleeve 77A is positioned within the hollow interior of spring 72 and between the spring 72 and the center tube 32 and an exterior sleeve 77B is positioned around the exterior of spring 72 and between the spring 72 and the rotating tube 32. In one arrangement, interior sleeve 77A and exterior sleeve 77B are formed of a plastic material or composite material. This helps to reduce noise and smooth operation, especially when rotating tube 20, center tube 32 and spring 72 are formed of a metallic material as the semi-compressible and self-lubricating properties of the plastic or composite material help to take up and reduce rattling while accommodating smooth operation.

In one arrangement, the counterbalance force produced by counterbalance assembly 62 does not perfectly match the forces generated by opening and closing the umbrella frame 24. In this arrangement, the counterbalance force of the counterbalance assembly is tailored to be neutral at approximately the middle of the opening and closing cycle.

To hold the umbrella frame 24 in a fully open or fully closed position, detents 80 are positioned in the exterior surface of rotating tube 20 at or near where the hub 28 is when the umbrella frame 24 is in a fully open and a fully closed position. In one arrangement, the upper end of upper collar 70A and the lower end of lower collar 70B include fingers 82 that are configured to frictionally engage and hold detents 80. When fingers 82 are engaged with or over detent 80, the force required to move past the detent 80 is greater than the force of gravity generated by the umbrella frame 24 and/or greater than the counterbalance force generated by the counterbalance assembly 62. As such, when the fingers 82 are engaged with a detent 80, the hub 28 remains in place.

Figure 13:
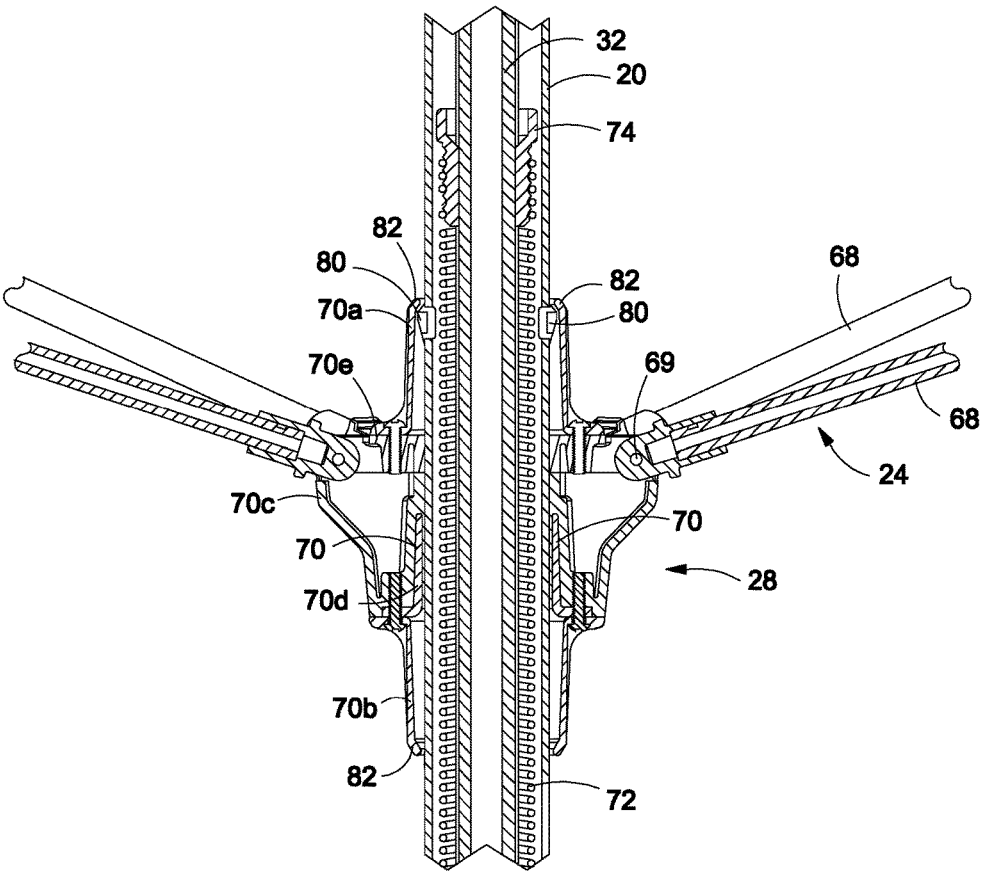
FIG. 13 is a close up side cut-away elevation view of the umbrella frame of FIG. 12, the view showing the center tube and counterbalance assembly positioned within the rotating tube, the view showing the umbrella frame in an open position, the view showing the elongated teeth in the hub that mesh with the helical grooves in the exterior surface of the rotating tube, the view showing the hub engaged with the detents in the exterior surface of the rotating tube which help to hold the umbrella frame in an open position.

Detents 80 can be formed out of any device or feature in the rotating tube 20 that helps hold hub 28 in place thereby overcoming the force of either the counterbalance assembly 62 or the force of the umbrella frame 24. In one arrangement, as is shown in FIG. 13, detents 80 include a single feature that protrudes out of the exterior surface of rotating tube 20. In this arrangement, as the umbrella frame 24 reaches the position of detent 80, the fingers 82 at the end of hub 28 stretch and fit around the single feature of the detents 80 thereby holding the umbrella frame 24 in place on the detent. This arrangement is considered a single-position detent.

Figure 14:
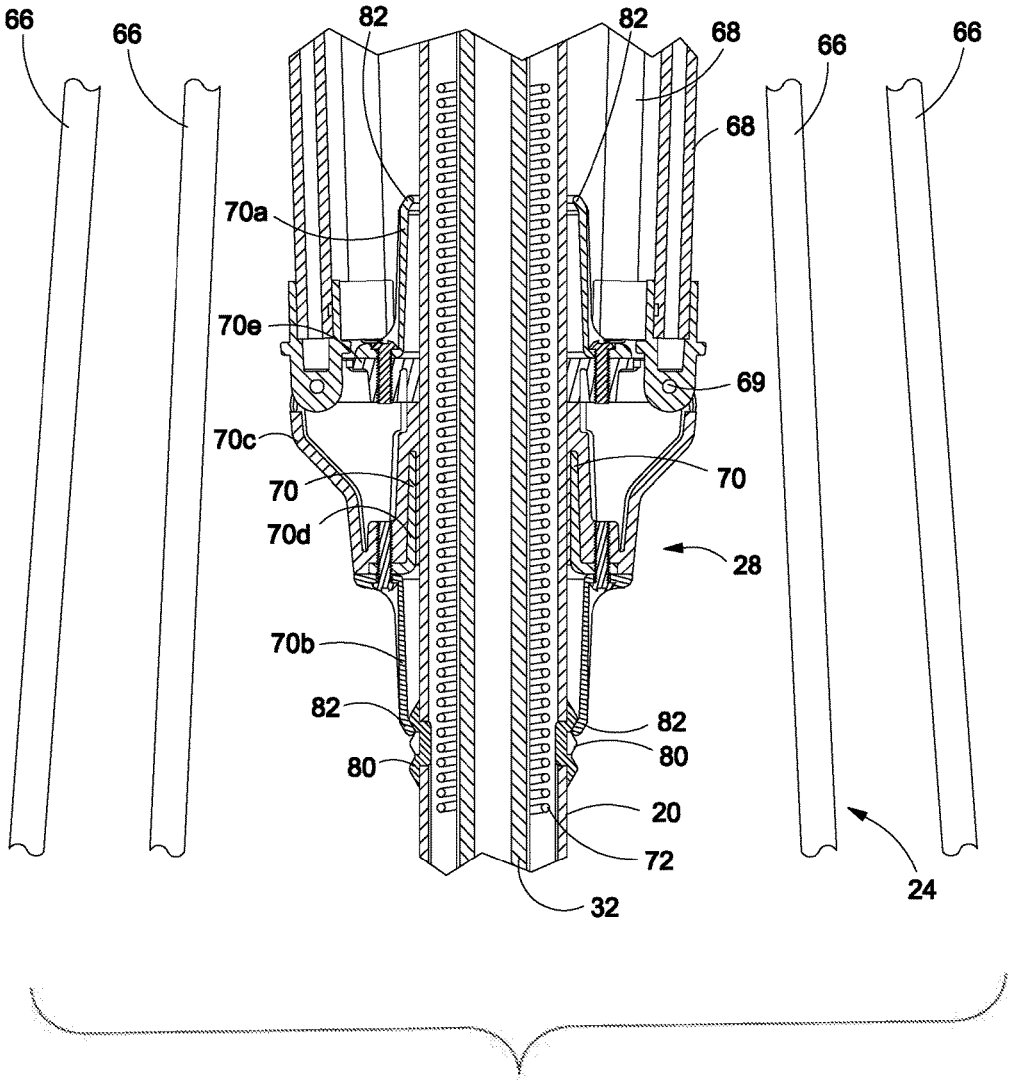
FIG. 14 is a close up side cut-away elevation view of the umbrella frame, the view showing the center tube and counterbalance assembly positioned within the rotating tube, the view showing the umbrella frame in a closed position, the view showing the elongated teeth in the hub that mesh with the helical grooves in the exterior surface of the rotating tube, the view showing the hub engaged with the detents in the exterior surface of the rotating tube which help to hold the umbrella frame in a closed position.
Figure 15:
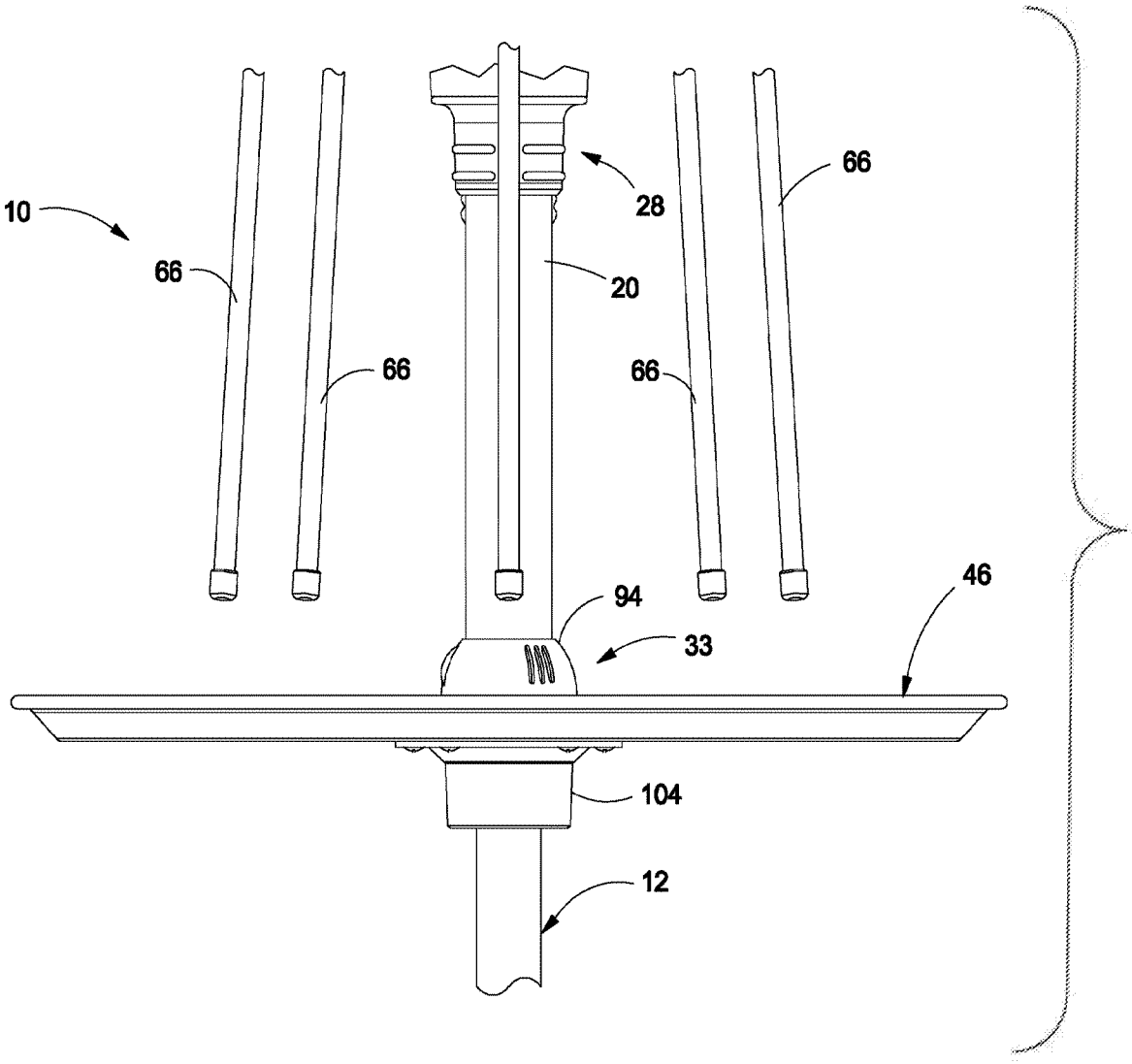
FIG. 15 is a side elevation view of the lower end of the rotating tube, the view showing the lower bearing assembly, the support pole, a table connected to the system and the view showing the hub engaged with detents that help to hold the umbrella frame in a closed position.
Figure 16:
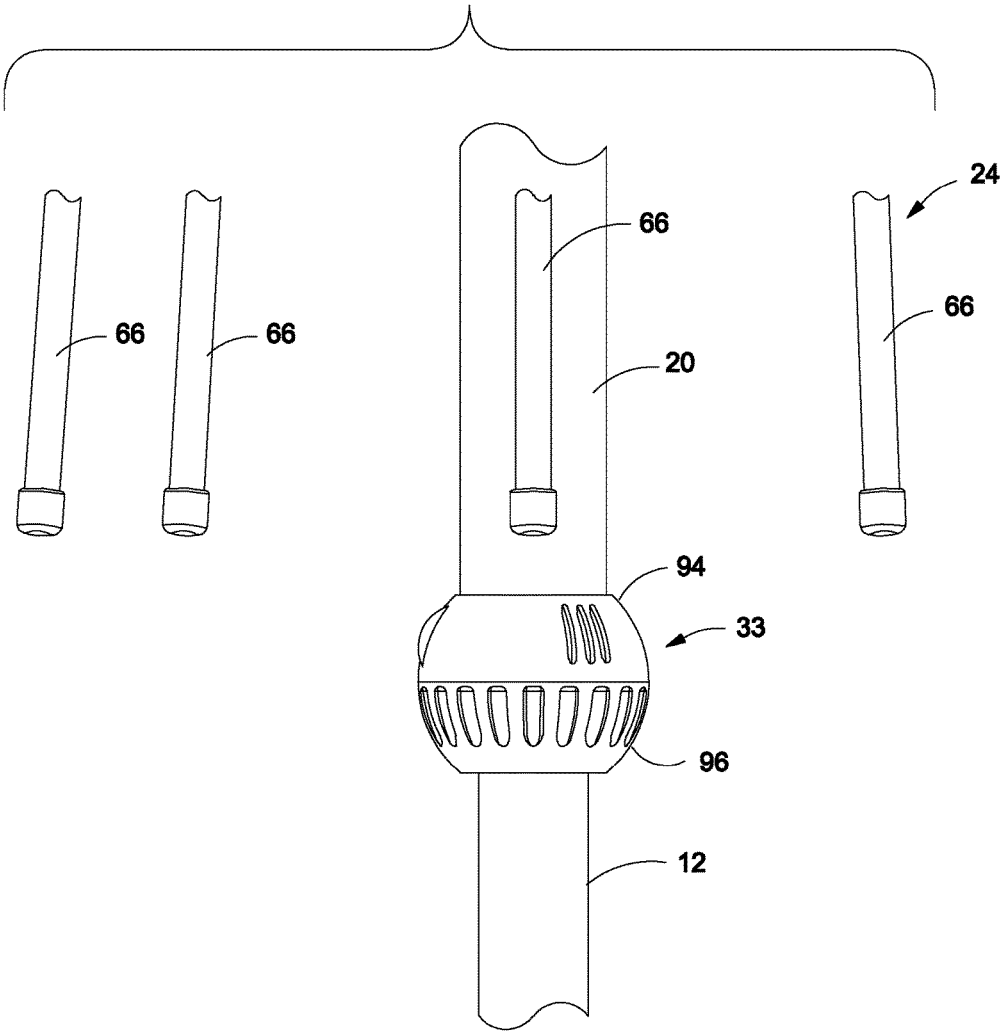
FIG. 16 is a side elevation view of the lower end of the rotating tube, the view showing the lower bearing assembly and the support pole without a table connected to the system, the view showing the umbrella frame in a closed position.
Figure 17:
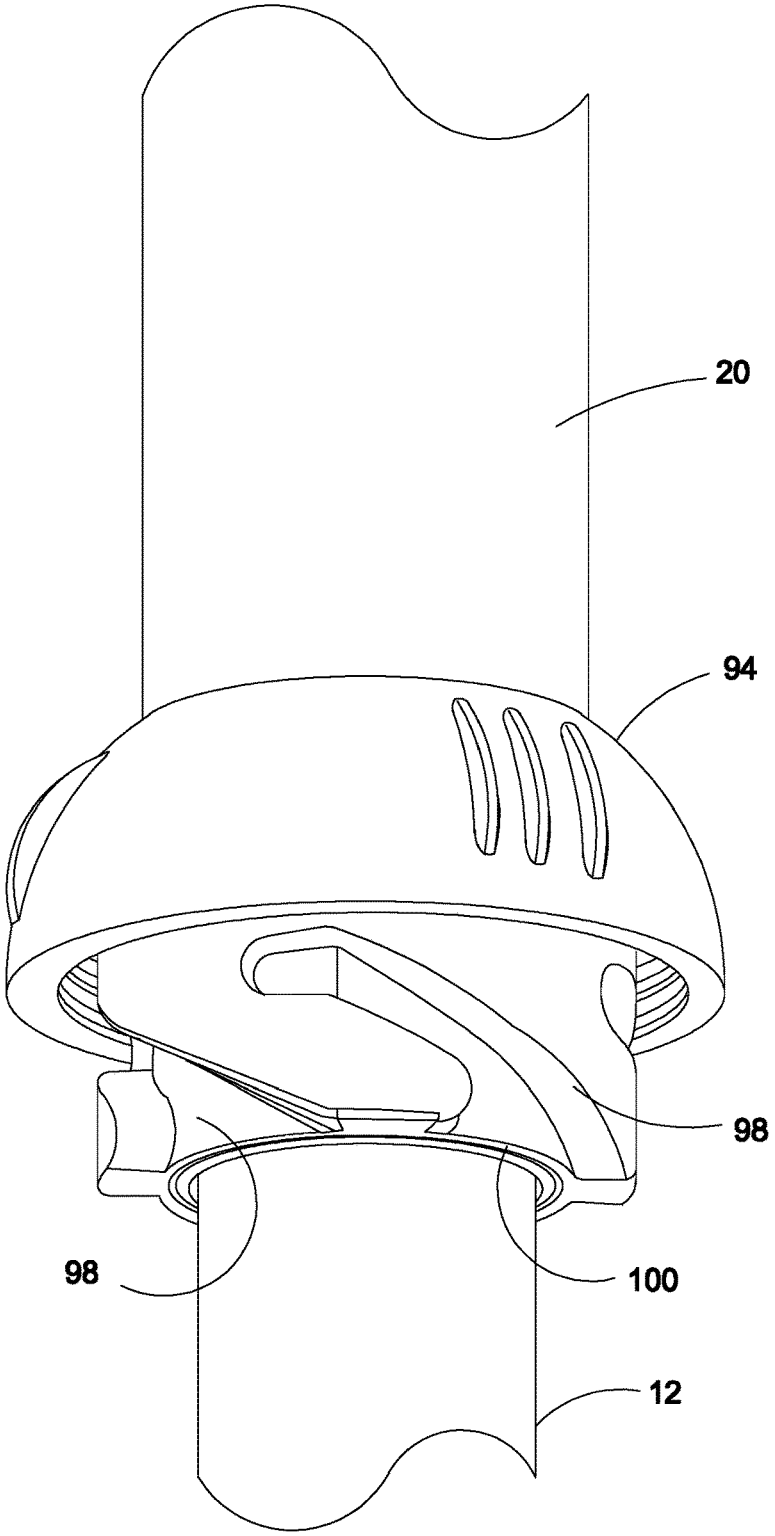
FIG. 17 is a close up side perspective view of the lower end of the rotating tube, the view showing the lower bearing assembly and the support pole without a table connected to the system, the view showing a connection mechanism in the lower bearing assembly, which is in this case a plurality of grooves, that are configured to facilitate connection of a table to the system.
Figure 18:
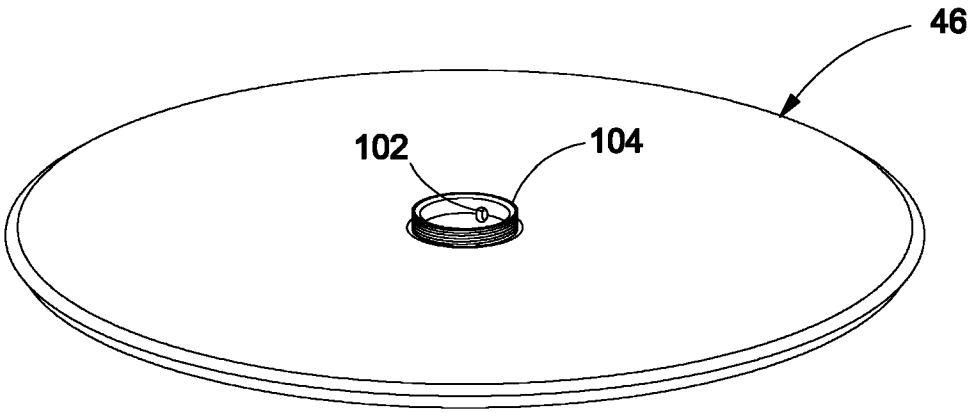
FIG. 18 is a perspective view of a table configured to be attached to the system.
Figure 19:
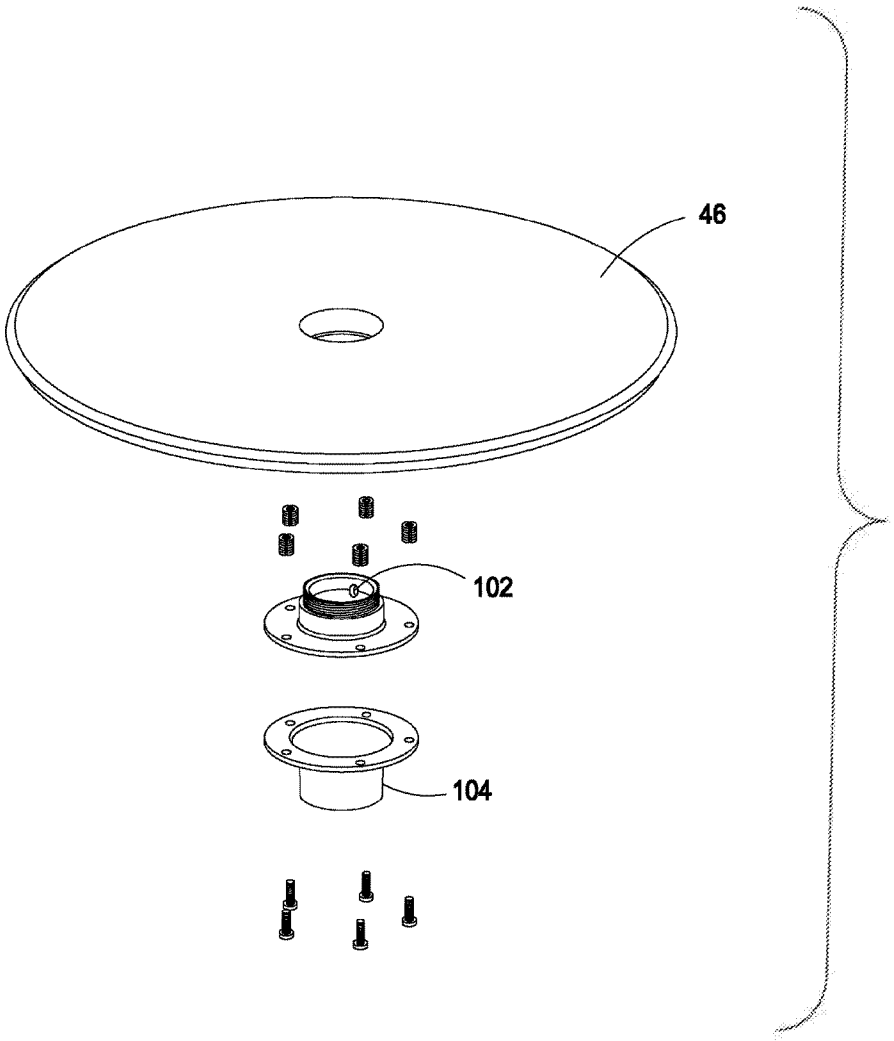
FIG. 19 is an exploded perspective view of the table of FIG. 18.
Figure 20:
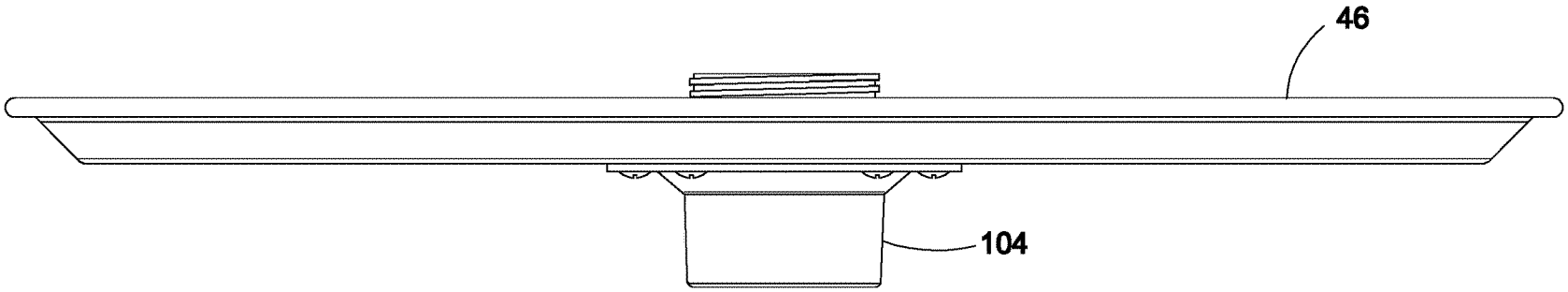
FIG. 20 is a side elevation view of the table of FIGS. 18 and 19.
Figure 21:
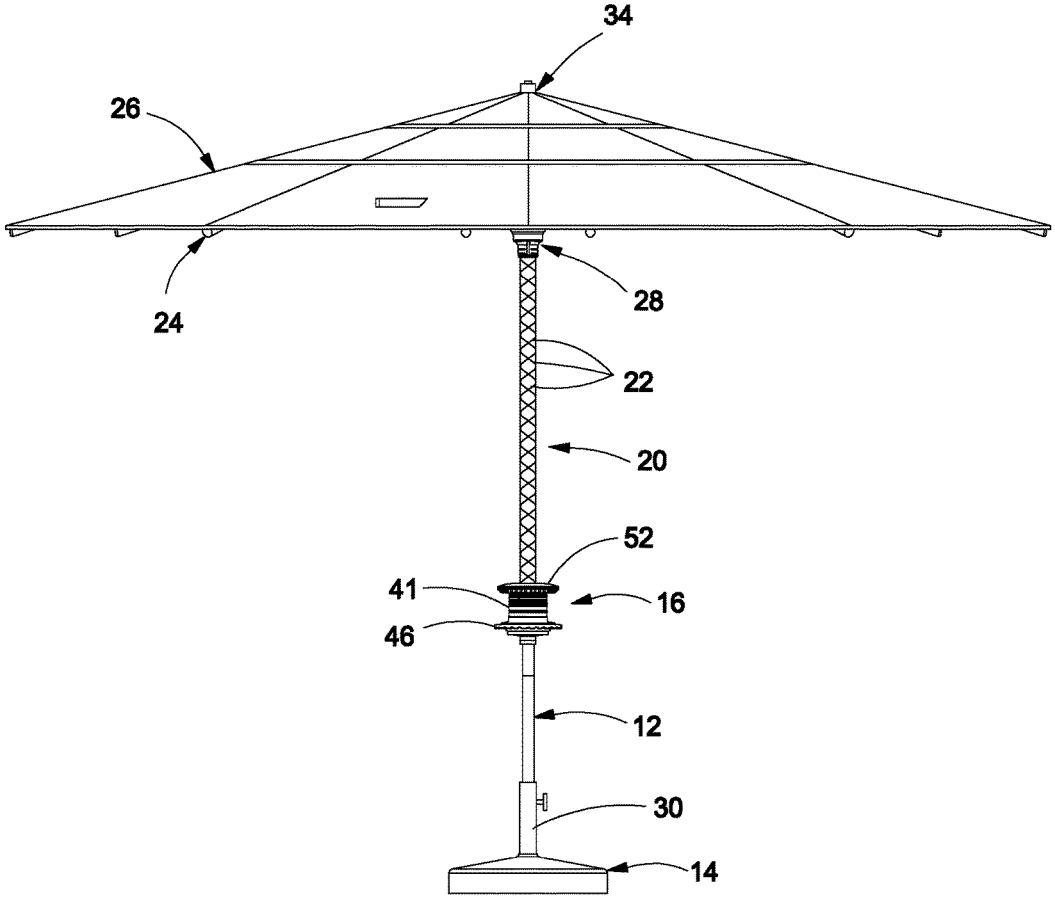
FIG. 21 is a side elevation view of the umbrella system of FIGS. 1-20 with the addition of a motor housing assembly that facilitates motorized opening and closing of the umbrella frame.
Figure 22:
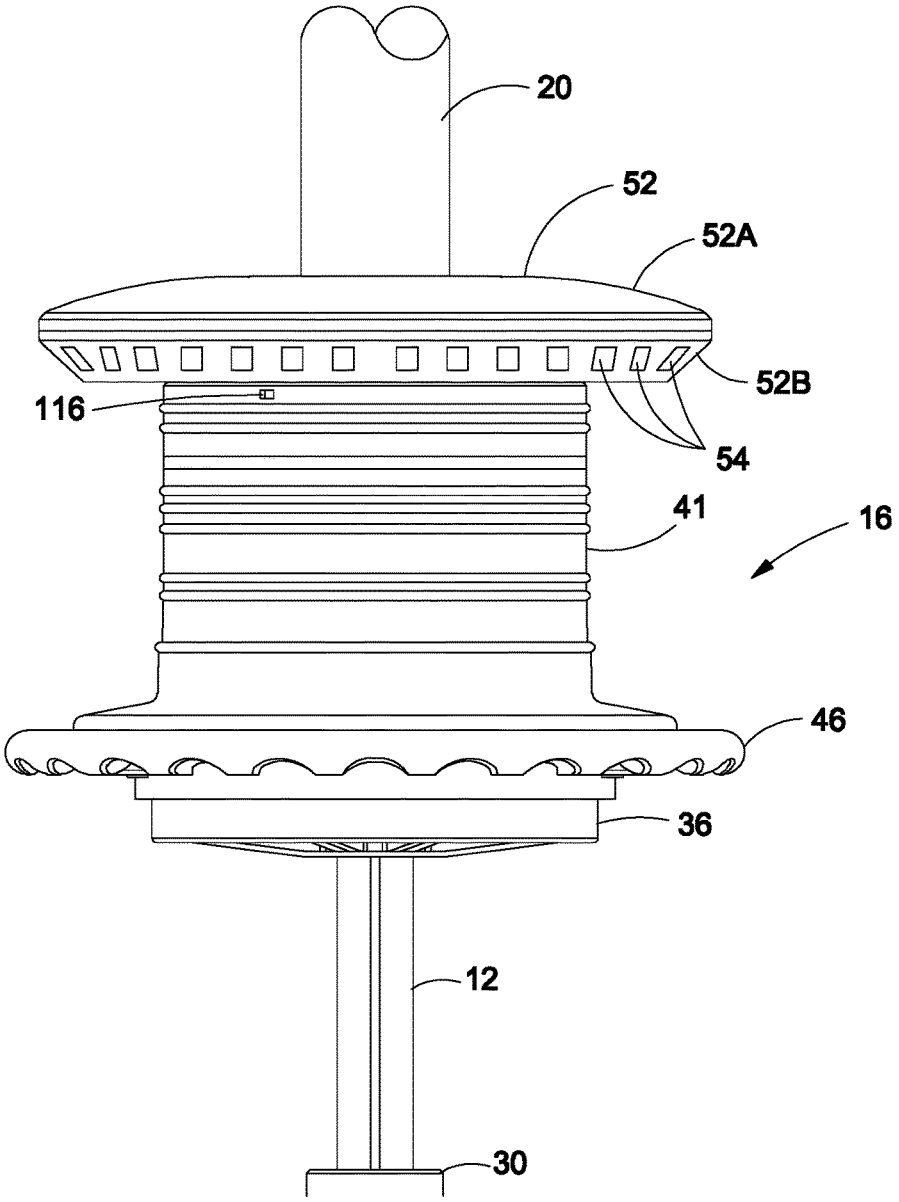
FIG. 22 is a close up side elevation view of the motor housing assembly of FIG. 21, the view showing the rotating tube, the support pole, the container, the switch, the table the cover and the stationary gear.
Figure 23:
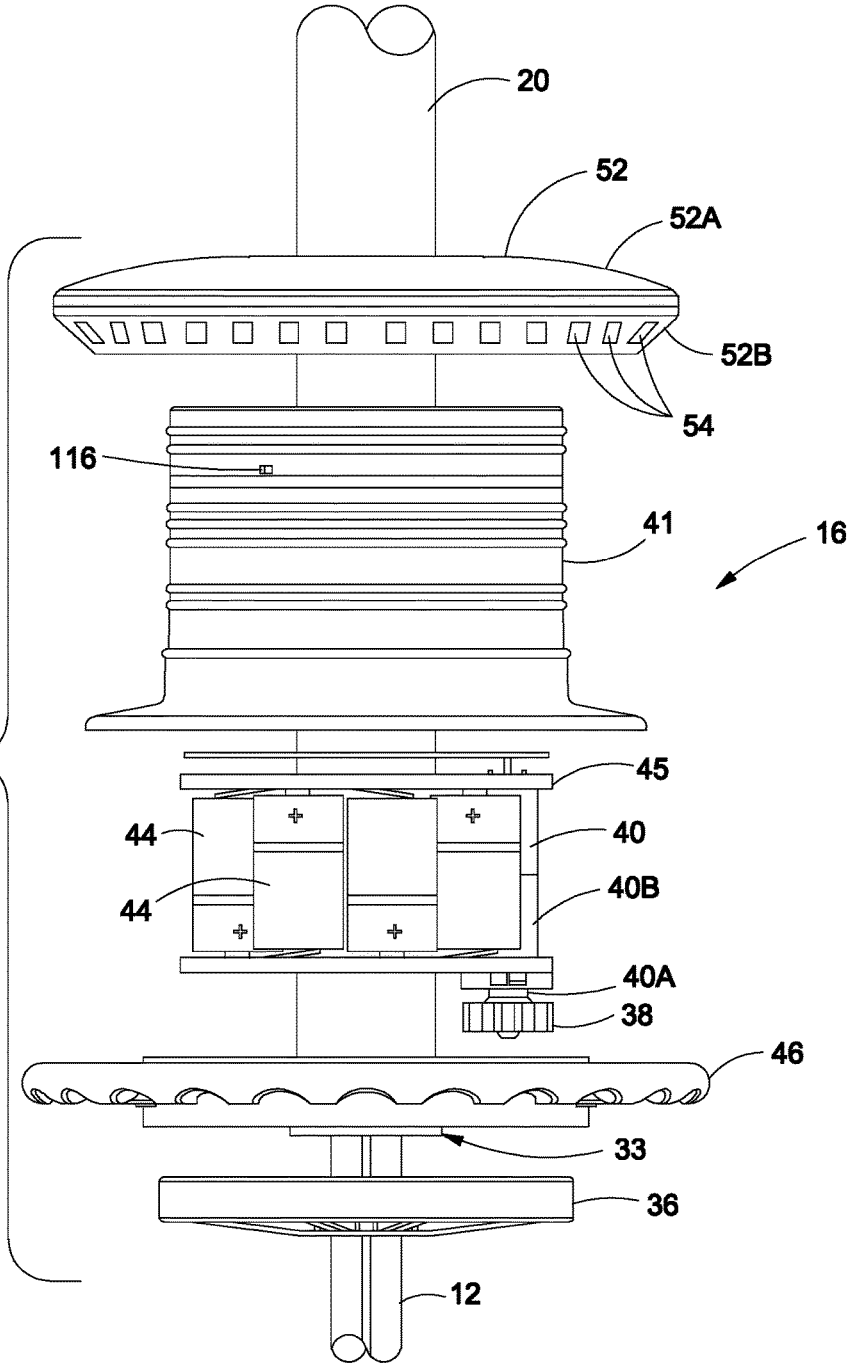
FIG. 23 is a close up exploded elevation view of the motor housing assembly of FIGS. 21 and 22, the view showing the rotating tube, the cover, the container, the battery holder that holds a plurality of batteries as well as the motor having a gear assembly, drive shaft and driven gear, the view showing the table and the stationary gear.
Figure 24:
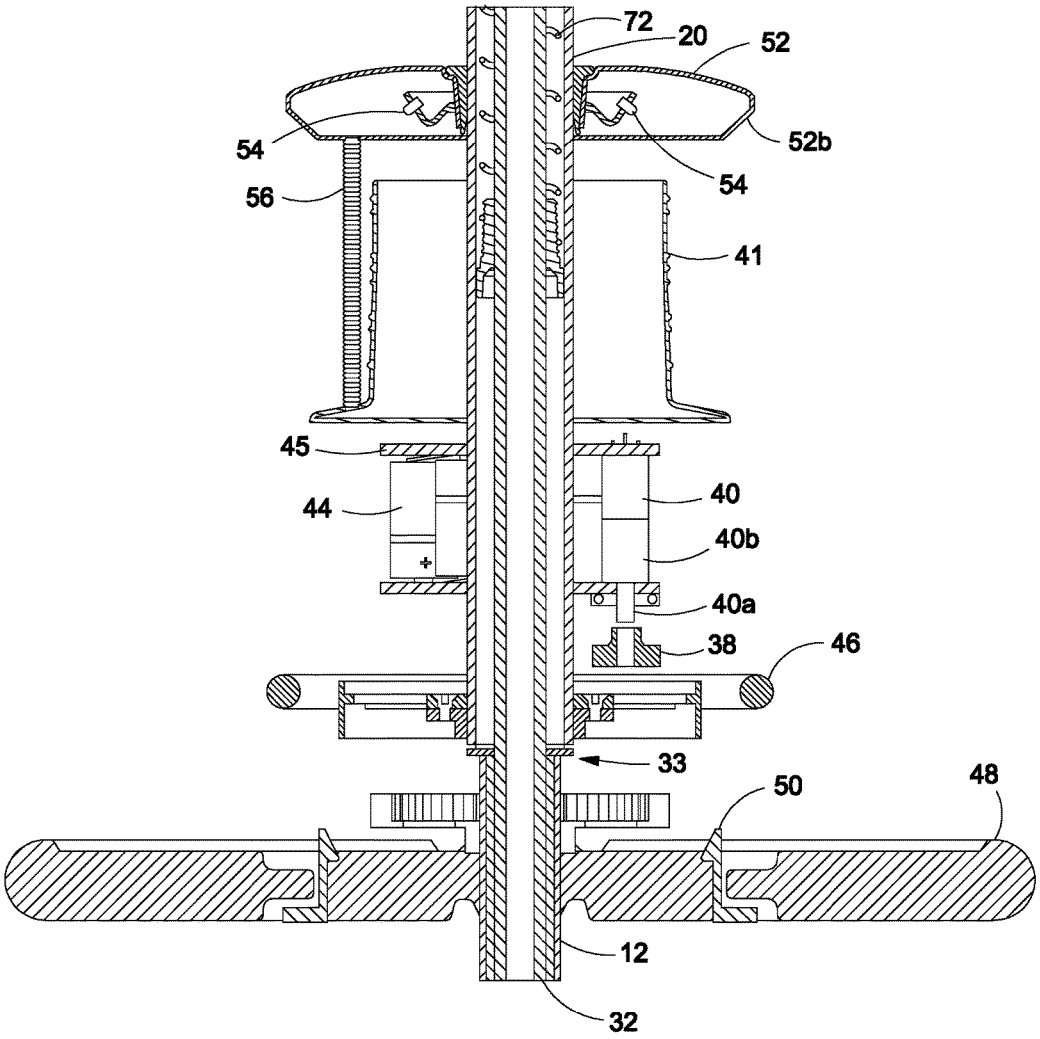
FIG. 24 is a close-up side cut away elevation view of the motor housing assembly of FIGS. 21-23, the view showing the rotating tube, the cover having lighting elements with the cover in a raised state and connected to the container by a cord, the view showing the container, the battery holder that holds a plurality of batteries as well as the motor having a gear assembly, drive shaft and driven gear, the view showing the table and the stationary gear, the view also showing a table extension connected by clips to the table.
Figure 25:
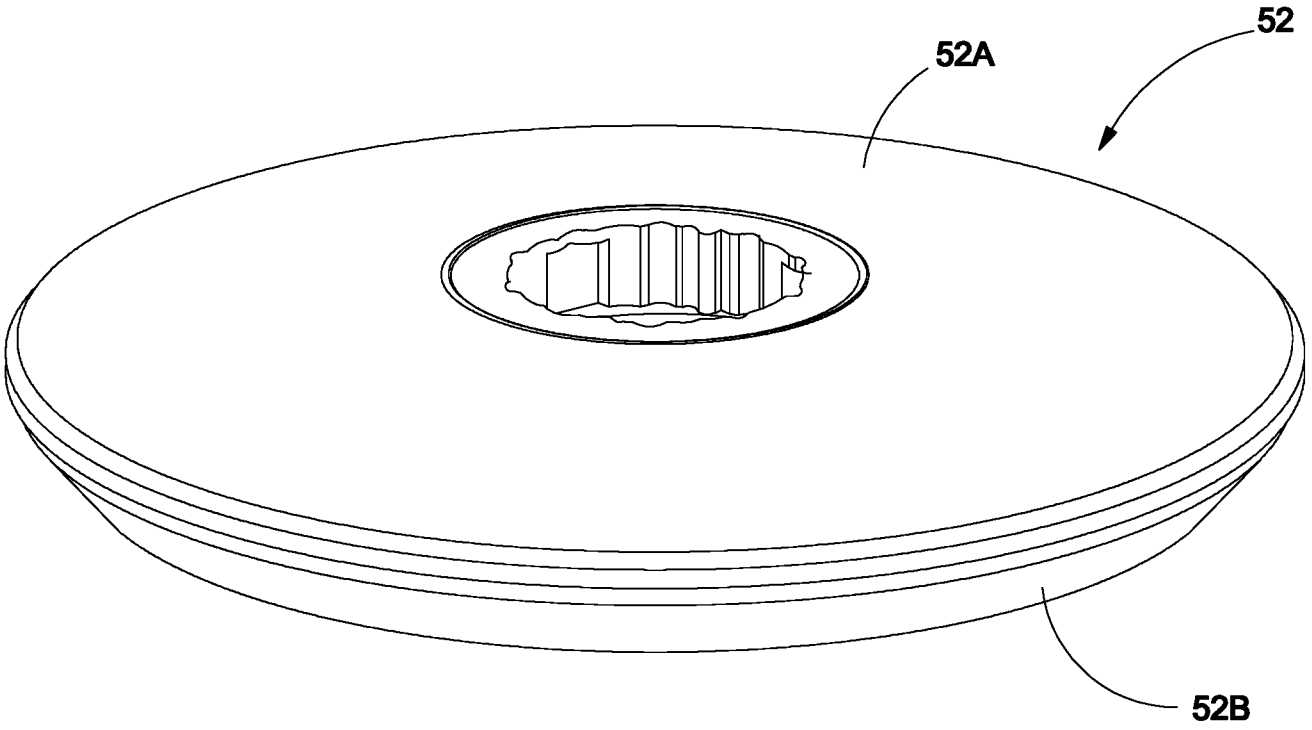
FIG. 25 is a perspective view of the cover of FIGS. 21-24.
Figure 26:
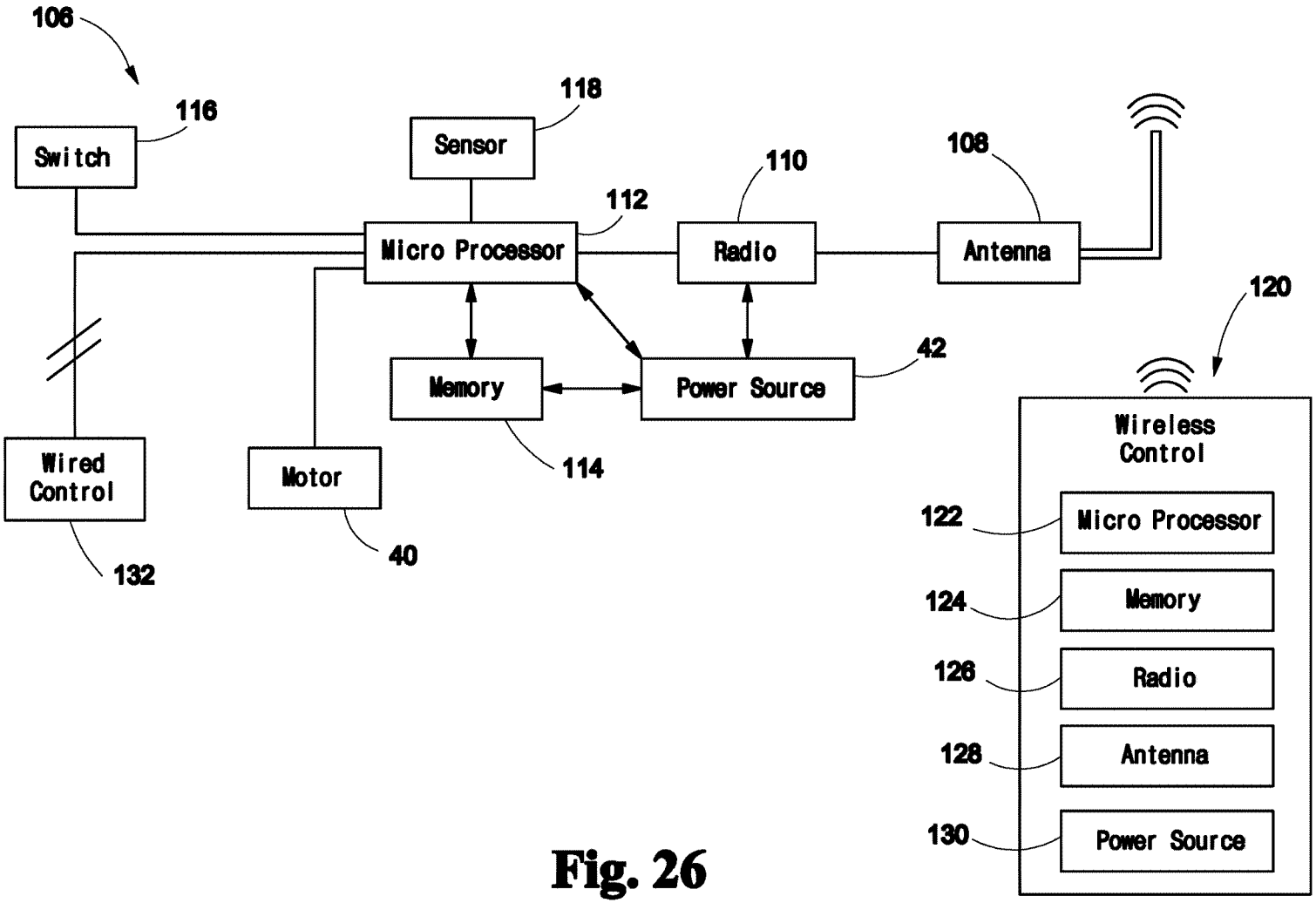
FIG. 26 is a plan view of the electronics of the system of FIGS. 21-25, the view showing the microprocessor, memory, radio, antenna and power source (which can be an on board power source such as a plurality of batteries, or an external power source such as wired connection to external power), the view also shows a wireless control, such as a conventional remote or a cell phone, tablet or any other control device capable of transmitting wireless control signals.

In another arrangement, as is shown in FIG. 14, detents 80 are formed of a plurality of protrusions in the exterior surface of rotating tube 20 or a single protrusion that has a plurality of steps or stops therein. In the arrangement shown in FIG. 14 detent 80 includes three positions. That is there are two recesses in the detent 80 presented which allows for three settings. That is, the fingers 82 can stop in the first recess (the first position), in the second recess (the second position) or past the entire detent (the third position). This arrangement is considered a multi-position detent. This arrangement allows for additional flexibility and control as the umbrella frame 24 can be held in place in a plurality of positions that can accommodate for stretching, give, differences in operation due to environmental conditions, and wear and tear of the umbrella system 10.

Center Support:

Center support 34 is formed of any suitable size, shape and design and facilitates connection of the upper end of umbrella frame to the upper end of center tube 32. In the arrangement shown, center support 34 includes a connecting collar 84 includes a plurality of recesses therein. These recesses receive the upper end of upper supports 66 and connect thereto with joints 69 that facilitate articulation of umbrella frame 24 during opening and closing. Center support 34 includes a cover 86 that covers and protects the area where connecting collar 84 connects to upper supports 66 and prevents water from entering at this point. Center support 34 also includes a center cap 88 that covers the upper end of center tube 32 and a pin 90 that connects center support 34 to center tube 32 thereby holding center support 34 in a non-rotational manner.

An upper bearing 92 is positioned at or near the upper end of rotating tube 20 and rotationally connects rotating tube 20 to non-rotational center tube 32 while facilitating rotation thereon.

Lower Bearing Assembly:

Lower bearing assembly 33 is formed of any suitable size shape and design. In the arrangement shown, lower bearing assembly 33 is positioned at the lower end of rotating tube and serves to cover the lower end of rotating tube 20. In the arrangement shown, lower bearing assembly 33 includes an upper cover 94 that connects with a lower cover 96. In the arrangement shown, when connected together the upper cover 94 and lower cover 96 have a generally spherical shape. A lower bearing 92 is positioned at or near the lower end of rotating tube 20 and rotationally connects rotating tube 20 to non-rotational center tube 32 while facilitating rotation thereon. This lower bearing 92 is held within the lower bearing assembly 33 and more specifically within the upper cover 94 and/or lower cover 96. When a table 46 is not used, the combined upper cover 94 and lower cover 96 provide a pleasing aesthetic appearance. In one arrangement, lower cover 96 threads onto upper cover 94.

When a table 46 is to be used with the system 10, in one arrangement the lower cover 96 is removed from the upper cover 94 by unthreading the lower cover 96 off of the upper cover 94 thereby exposing locking features 98 in lower collar extension 100. In this position, upper cover 94 is free from lower collar extension 100 and upper cover 94 can be slid vertically along the length of rotating tube 20. Locking features 98 of lower collar extension 100 are any form of a feature or device that facilitates connection of table 46 to lower bearing assembly 33 such as threads, grooves, a bolt or screw, a snap fit feature, or any other manner or method of connecting two components together. In the arrangement shown, locking features 98 are a plurality of grooves that are sized and shaped to receive a locking feature 102 in table 46 and include a landing area at the top of the grooves that is configured to hold the locking features 102 therein.

More specifically, in one arrangement, table 46 includes a center collar 104 that holds a plurality of locking features 102 therein. In this arrangement, center collar 104 matingly fits over the lower collar extension 100 of lower bearing assembly 33 and the locking features 102 of table 46 matingly engage the locking features 98 of lower bearing assembly 33 thereby connecting table 46 to lower bearing assembly 33 and rotating tube 20. Once the table 46 is fully installed upon the lower collar extension 100 with the locking features 102 of table 46 matingly engage the landing areas of locking features 98 of lower bearing assembly 33, then the upper cover 94 is threaded over the threads in the upper exterior surface of center collar 104 of table 46. In this way, the upper cover 94 locks the table 46 into position on the lower collar extension 100. Any other manner or method of connecting table 46 to either stationary center tube 32 or rotating tube 20 is hereby contemplated for use.

Electronic Components: When umbrella system 10 is motorized, the motor housing assembly 16 includes or is connected to a motor controller assembly 106 that includes or is electrically connected to the electronic components that facilitate operation of the system 10. In one arrangement, motor controller assembly 106 includes an antenna 108 connected to a radio 110, which can be a receiver or a transceiver. Antenna 108 is any device that receives and/or transmits wireless control signals. Radio 110 is a receiver when only one-way communication is utilized, that is the motor controller assembly 106 only receives wireless control signals; whereas radio 110 is a transceiver when two-way communication is utilized, that is the motor controller assembly 106 both receives and sends wireless control signals. Radio 110 serves to receive wireless control signals from antenna 108 and/or transmit wireless control signals through antenna 108. Radio 110 is connected to a microprocessor 112 and memory 114. Microprocessor 112 is any device that receives information and processes information according to instructions, software or code stored on memory 114. Memory 114 is any form of a device that facilitates data storage and retrieval such as flash, RAM, a hard drive or the like. Microprocessor 112 and memory 114 may be formed of a single combined device or they may be formed of separate devices, or they may be formed of multiple devices.

Microprocessor 112 is electrically connected to motor 40 and controls operation of motor 40. That is, microprocessor 112 turns-on and turns-off motor 40, and controls the direction of rotation of motor 40, thereby opening and closing the umbrella frame 24.

In one arrangement, a switch 116 is electrically connected to motor 40 and/or microprocessor 112. When activated, switch 116 operates to power motor 40 thereby opening and closing umbrella frame 24.

In one arrangement, one or more sensors 118 are electrically connected to microprocessor 112 and when a predetermined condition is sensed by a sensor 118 and this information is transmitted to microprocessor 112, microprocessor 112 controls operation of motor 40 according to instructions stored in memory 114. Sensor 118 is formed of any sensing device such as a current sensor, a motion sensor, a vibration sensor or any other form of a sensor. In one arrangement, sensor 118 is configured to detect a manual rotation of table 46 and/or rotating tube 20 and when this motion is detected the microprocessor 112 initiates motorized opening or closing of the umbrella frame 24. In one arrangement, a sensor 118 is configured to detect when the umbrella frame 24 is in a fully opened and/or fully closed position and to stop movement once this fully opened or fully closed position is achieved.

In one arrangement, a wireless control 120 is wirelessly connected to motor controller assembly 106 through wireless connection to antenna 108 and thereby facilitates wireless control of motorized umbrella system 10. Wireless control 120 is any device that is capable of transmitting wireless control signals and wirelessly controlling motorized umbrella system 10 and may include a conventional remote control, a hand held device, a home automation system, a cell phone, a laptop or the like. In one arrangement, like motor controller assembly, wireless control 120 includes a microprocessor 122, memory 124, a radio 126, an antenna 128 and a power source 130 among other components.

When wireless control 120 transmits a wireless control signal, it is received by antenna 108 of motor controller assembly 106. This signal is transmitted to radio 110 and processed. Radio 110 transmits the processed signal to microprocessor 112. Microprocessor 112 processes the information from radio 110 according to instructions stored in memory 114. When wireless control 120 transmits an open signal, microprocessor 112 opens umbrella system 10; when wireless control 120 transmits a close signal, microprocessor closes umbrella system 10.

In an alternative arrangement, a wired control 132 is connected via a cable or other wiring system to motor controller assembly 106 and/or microprocessor 112. In one arrangement, the electronic components of the system are also powered by this wired connection, which eliminates the need for batteries 44.

In operation, when motor 40 is activated, by pressing a button on wireless control 12 or wired control 132 or by initiating rotation of the table 46 microprocessor 122 controls motor 40 which rotates driven gear 38 which meshingly drives around stationary gear 36 thereby rotating motor housing assembly 16, including table 46, and rotating tube 20. As rotating tube 20 rotates, hub 28 is driven along the length of rotating tube 20 by engagement of its teeth 70 with helical groove 22. As hub 28 is driven, the umbrella frame 24 articulates upon center support 34 and hub 28 thereby opening or closing the umbrella frame 24.

When hub 28 engages a full open or full closed position, fingers 82 engage detents 80 and the umbrella frame 24 is held in place after the motor 40 ceases to be powered.

Manual System:

While the system shown herein includes a motor 40 and is thereby operated by motorization a manual system is hereby contemplated wherein motor 40, and the electronic components are removed. In this arrangement, umbrella frame 24 is raised or lowered by manually. This manual opening or closing can be accomplished by a plurality of manners, which is due in large part to the counterbalance assembly 62 that counteracts the forces of opening an umbrella. The manual umbrella system 10 can be opened by simply grasping the umbrella frame 24, at or near the ends of upper supports 66 and pulling them up or pushing them down until the fingers 82 engage a detent 80 when the umbrella frame 24 is in a fully opened or fully closed position. The manual umbrella system 10 can be opened by simply grasping the rotating tube 20 and rotating it until the fingers 82 engage a detent 80 when the umbrella frame 24 is in a fully opened or fully closed position. The manual umbrella system 10 can be opened by simply grasping the rotating table 46 and rotating it until the fingers 82 engage a detent 80 when the umbrella frame 24 is in a fully opened or fully closed position. In doing so, the umbrella frame 24 is very easy to open due to the counterbalance assembly 62.

Auto Close Function:

Problems occur when umbrellas are left open, such as when a storm kicks up. As such, in one arrangement, system 10 includes an auto-close function that automatically closes umbrella frame 24 upon certain functions or conditions. In one arrangement, sensor 118 is a time sensor and the microprocessor 112 is programmed to close the umbrella frame 24 if left open after a predetermined time. In another arrangement, sensor 118 is a light sensor and the microprocessor 112 is programmed to close the umbrella frame 24 if left open after a predetermined darkness level. In another arrangement, sensor 118 is a wind sensor and the microprocessor 112 is programmed to close the umbrella frame 24 if left open and wind exceeds a predetermined threshold. Any other trigger can be used and is hereby contemplated for use to initiate an auto close operation.

From the above discussion and the accompanying drawings and claims it will be appreciated that the umbrella system presented: improves upon the state of the art; is easier to deploy; is easier to retract; auto opens; auto closes; is powered by batteries; does not need to be plugged into a conventional power source to be operable; is aesthetically pleasing; improves safety; can be remotely opened; can be remotely closed; can be manually opened or closed; can be opened or closed by motorization; improves the ergonomics of opening or closing an umbrella; can be used with large umbrellas; is relatively inexpensive to manufacture; has a minimum number of parts; counterbalances the weight of the umbrella; has an intuitive design; has a long useful life; is rugged; is durable; utilizes standard batteries.

It will be appreciated by those skilled in the art that other various modifications could be made to the device without parting from the spirit and scope of this invention. All such modifications and changes fall within the scope of the claims and are intended to be covered thereby. It should be understood that the examples and embodiments described herein are for illustrative purposes only and that various modifications or changes in light thereof will be suggested to persons skilled in the art and are to be included within the spirit and purview of this application.

The invention claimed is:

1. An umbrella system comprising:

a rotating tube;

the rotating tube having at least one helical groove therein;

an umbrella frame operably connected to the rotating tube;

wherein rotation of the rotating tube moves the umbrella frame between an open position and a closed position wherein the at least one helical groove includes a first helical groove and a second helical groove, wherein the first helical groove and the second helical groove are positioned on opposing sides of the rotating tube.

2. The umbrella system of claim 1 further comprising, a counterbalance assembly operably connected to the rotating tube, wherein the counterbalance is configured to provide a counterbalance force to the rotating tube.

3. The umbrella system of claim 1 further comprising, a counterbalance assembly operably connected to the rotating tube, wherein the counterbalance is configured to provide a counterbalance force to the rotating tube, wherein the counterbalance assembly includes a torsion spring positioned within the rotating tube.

4. The umbrella system of claim 1 further comprising a motor operatively connected to the rotating tube, wherein the motor is configured to rotate the rotating tube and thereby open and close the umbrella system.

5. The umbrella system of claim 4 further comprising a sensor electrically connected to the motor and configured to activate the motor to open or close the umbrella based upon sensed conditions.

6. The umbrella system of claim 5 wherein the sensor is a light sensor, a wind sensor or a temperature sensor.

7. The umbrella system of claim 1 further comprising a power source electrically connected to system, wherein the power source is formed of one or a plurality of batteries.

8. The umbrella system of claim 1 wherein the umbrella system is connected to an external power source.

9. The umbrella system of claim 1 further comprising a motor controller electrically connected to a motor, a wireless controller wirelessly connected to the motor controller, wherein the umbrella system is configured to open and close by the wireless controller.

10. The umbrella system of claim 9 wherein the motor controller includes a microprocessor, a radio and an antenna that are electrically connected together.

11. The umbrella system of claim 9 wherein the wireless controller is configured to transmit wireless control signals to the motor controller.

12. The umbrella system of claim 1 wherein the umbrella frame is opened and closed by manual rotation of the rotating tube.

13. The umbrella system of claim 1 further comprising a detent system that is configured to hold the umbrella frame in an open position.

14. The umbrella system of claim 1 further comprising a detent system that is configured to hold the umbrella frame in a closed position.

15. The umbrella system of claim 1 further comprising a plurality of lights.

16. The umbrella system of claim 1 further comprising a table.

17. An umbrella system comprising:

a rotating tube;

the rotating tube having at least one helical groove therein;

a center tube extending through the rotating tube;

an umbrella frame operably connected to the center tube;

a hub operably connected to the rotating tube and operably connected to the umbrella frame;

wherein when the rotating tube rotates, the hub is driven along a length of the rotating tube thereby opening or closing the umbrella frame;

wherein the at least one helical groove includes a first helical groove and a second helical groove, wherein the first helical groove and the second helical groove are positioned on opposing sides of the rotating tube.

18. The umbrella system of claim 17 further comprising the hub having at least one tooth that operably engages the at least one helical groove of the rotating tube.

19. An umbrella system comprising:

a tube;

the tube extending a length from a lower end to an upper end;

the tube having at least one helical groove therein;

the tube having a hollow interior;

an umbrella frame operably connected to the tube;

the umbrella frame configured to move between an open position and a closed position;

a counterbalance assembly;

the counterbalance assembly positioned within the hollow interior of the tube;

wherein the counterbalance assembly is configured to provide a counterbalance force to counter weight of the umbrella frame;

wherein the at least one helical groove includes a first helical groove and a second helical groove, wherein the first helical groove and the second helical groove are positioned on opposing sides of the tube.

20. The umbrella system of claim 19, wherein the counterbalance assembly includes a spring.

21. The umbrella system of claim 19, wherein the tube rotates.

22. The umbrella system of claim 19, wherein a center tube extends through the tube and provides support to the umbrella frame.

23. An umbrella system comprising:

a tube;

the tube having at least one helical groove therein;

an umbrella frame operably connected to the tube;

a motor operably connected to the umbrella system;

the motor configured to open and close the umbrella system;

a motor controller operably connected to the motor;

a wireless control;

the wireless control operably connected to the motor controller;

wherein when the wireless control transmits a control signal to the motor controller, the motor is activated and the umbrella frame is opened or closed;

wherein the at least one helical groove includes a first helical groove and a second helical groove, wherein the first helical groove and the second helical groove are positioned on opposing sides of the tube.

24. The umbrella system of claim 23 wherein the motor controller includes an antenna, radio and microprocessor electrically connected to the motor.

25. The umbrella system of claim 23 further comprising a switch electrically connected to the motor and configured to operate the motor, wherein the umbrella system is also opened or closed by activation of the switch.

26. The umbrella system of claim 23 wherein the umbrella system is also opened or closed by a manual movement that initiates motorized movement.

27. The umbrella system of claim 23 wherein the umbrella system is also opened or closed by manual movement.

* * * * *